US010975450B2

(12) United States Patent
Okatsu et al.

(10) Patent No.: US 10,975,450 B2
(45) **Date of Patent: *Apr. 13, 2021**

(54) LOW ALLOY HIGH STRENGTH THICK-WALLED SEAMLESS STEEL PIPE FOR OIL COUNTRY TUBULAR GOODS

(71) Applicant: JFE Steel Corporation, Tokyo (JP)

(72) Inventors: Mitsuhiro Okatsu, Tokyo (JP); Masao Yuga, Tokyo (JP); Kenichiro Eguchi, Tokyo (JP); Haruo Nakamichi, Tokyo (JP)

(73) Assignee: JFE Steel Corporation, Tokyo (JP)

( * ) Notice: Subject to any disclaimer, the term of this patent is extended or adjusted under 35 U.S.C. 154(b) by 156 days.

This patent is subject to a terminal disclaimer.

(21) Appl. No.: 16/078,927

(22) PCT Filed: Nov. 18, 2016

(86) PCT No.: PCT/JP2016/004916

§ 371 (c)(1),
(2) Date: Aug. 22, 2018

(87) PCT Pub. No.: WO2017/149572

PCT Pub. Date: Sep. 8, 2017

(65) Prior Publication Data

US 2019/0055617 A1 Feb. 21, 2019

(30) Foreign Application Priority Data

Feb. 29, 2016 (JP) ..... JP2016-036576

(51) Int. Cl.
*C21D 8/10* (2006.01)
*C22C 38/32* (2006.01)
(Continued)

(52) U.S. Cl.
CPC ..... *C21D 8/105* (2013.01); *C21D 8/10* (2013.01); *C22C 38/00* (2013.01); *C22C 38/001* (2013.01);
(Continued)

(58) Field of Classification Search
CPC .... C21D 2211/004; C21D 8/10; C21D 8/105; C21D 9/08; C22C 38/00
(Continued)

(56) References Cited

U.S. PATENT DOCUMENTS 6,267,828 B1 7/2001 Kushida et al.
8,168,010 B2 5/2012 Omura et al.
(Continued)

FOREIGN PATENT DOCUMENTS

CN 102409240 A 4/2012
EP 1785501 A1 5/2007
(Continued)

OTHER PUBLICATIONS

Final Office Action for U.S. Appl. No. 15/527,893, dated Jan. 6, 2020, 21 pages.
(Continued)

*Primary Examiner* — Jie Yang
(74) *Attorney, Agent, or Firm* — RatnerPrestia

(57) ABSTRACT

A low alloy high strength thick-walled seamless steel pipe for oil country tubular goods is provided having a wall thickness of 40 mm or more and a yield strength of 758 MPa or more, the steel pipe including a composition containing, in terms of mass %, C: 0.25 to 0.31%, Si: 0.01 to 0.35%, Mn: 0.55 to 0.70%, P: 0.010% or less, S: 0.001% or less, O: 0.0015% or less, Al: 0.015 to 0.040%, Cu: 0.02 to 0.09%, Cr: 0.8 to 1.5%, Mo: 0.9 to 1.6%, V: 0.04 to 0.10%, Nb: 0.005 to 0.05%, B: 0.0015 to 0.0030%, Ti: 0.005 to 0.020%, and N: 0.005% or less, and having Ti/N of 3.0 to 4.0, with
(Continued)

NACE TM0177 method D DCB specimen the balance being Fe and inevitable impurities, wherein a cumulative frequency rate at a measurement point at which a Mo segregation degree by a predetermined expression is 1.5 or more is 1% or less.

2 Claims, 4 Drawing Sheets

(51) Int. Cl.

| | |
|---|---|
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/22*** | (2006.01) |
| ***C22C 38/24*** | (2006.01) |
| ***C22C 38/26*** | (2006.01) |
| ***C22C 38/28*** | (2006.01) |
| *C21D 9/08* | (2006.01) |

(52) U.S. Cl.
CPC ..... *C22C 38/002* (2013.01); *C22C 38/02* (2013.01); *C22C 38/04* (2013.01); *C22C 38/06* (2013.01); *C22C 38/22* (2013.01); *C22C 38/24* (2013.01); *C22C 38/26* (2013.01); *C22C 38/28* (2013.01); *C22C 38/32* (2013.01); *C21D 9/08* (2013.01); *C21D 2211/004* (2013.01)

(58) Field of Classification Search
USPC ..... 148/330
See application file for complete search history.

(56) References Cited

U.S. PATENT DOCUMENTS

| | | | | |
|---|---|---|---|---|
| 2006/0016520 | A1 | 1/2006 | Numata et al. | |
| 2009/0098403 | A1 | 4/2009 | Omura et al. | |
| 2012/0186704 | A1 | 7/2012 | Eguchi et al. | |
| 2014/0352836 | A1 | 12/2014 | Eguchi et al. | |
| 2019/0048443 | A1* | 2/2019 | Okatsu | C22C 38/04 |
| 2019/0048444 | A1* | 2/2019 | Okatsu | E21B 17/00 |

FOREIGN PATENT DOCUMENTS

| | | | |
|---|---|---|---|
| EP | 2133443 | A1 | 12/2009 |
| EP | 2824198 | A1 | 1/2015 |
| EP | 3153597 | A1 | 4/2017 |
| JP | 2000178682 | A | 6/2000 |
| JP | 2001172739 | A | 6/2001 |
| JP | 2002060893 | A | 2/2002 |
| JP | 2005350754 | A | 12/2005 |
| JP | 2014012890 | A | 1/2014 |
| JP | 2014129594 | A | 7/2014 |
| JP | 2015183197 | A | 10/2015 |
| WO | 2008123425 | A1 | 10/2008 |
| WO | 2015190377 | A1 | 12/2015 |

OTHER PUBLICATIONS

Extended European Search Report for European Application No. 16 892 417.3, dated Mar. 25, 2019, 13 pages.
Non Final Office Action for U.S. Appl. No. 15/537,703, dated Oct. 30, 2019, 11 pages.
Final Office Action for U.S. Appl. No. 15/509,350, dated Sep. 5, 2019, 20 pages.
Non Final Office Action for U.S. Appl. No. 15/537,669, dated Oct. 30, 2019, 12 pages.
Non Final Office Action for U.S. Appl. No. 15/527,893, dated Jun. 24, 2019, 28 pages.
European Communication pursuant to Article 94(3) EPC for European Application No. 16 892 417.3, dated Dec. 18, 2019, 4 pages.
International Search Report and Written Opinion for International Application No. PCT/JP2016/004916, dated Feb. 21, 2015—5 pages.
Final Office Action for U.S. Appl. No. 15/537,669, dated Apr. 30, 2020, 18 pages.
Non Final Office Action for U.S. Appl. No. 15/527,893, dated May 12, 2020, 11 pages.
Non Final Office Action for U.S. Appl. No. 16/078,919, dated Jul. 10, 2020, 51 pages.
Non Final Office Action for U.S. Appl. No. 16/078,924, dated Jul. 24, 2020, 49 pages.
Final Office Action for U.S. Appl. No. 15/527,893, dated Aug. 19, 2020, 7 pages.
Final Office Action for U.S. Appl. No. 16/078,919, dated Feb. 10, 2021, 20 pages.

* cited by examiner

NACE TM0177 method D DCB specimen

LOW ALLOY HIGH STRENGTH THICK-WALLED SEAMLESS STEEL PIPE FOR OIL COUNTRY TUBULAR GOODS

CROSS REFERENCE TO RELATED APPLICATIONS

This is the U.S. National Phase application of PCT/JP2016/004916, filed Nov. 18, 2016, which claims priority to Japanese Patent Application No. 2016-036576, filed Feb. 29, 2016, the disclosures of these applications being incorporated herein by reference in their entireties for all purposes.

TECHNICAL FIELD OF THE INVENTION

The present invention relates to a high strength thick-walled seamless steel pipe for oil country tubular goods or gas well, which is excellent in sulfide stress corrosion cracking resistance (SSC resistance) especially in a hydrogen sulfide-containing sour environment. The term "high strength" referred to herein refers to a case of having a strength of 758 MPa or more (110 ksi or more) in terms of yield strength, and the term "thick-walled" refers to a case where a wall thickness of the steel pipe is 40 mm or more.

BACKGROUND OF THE INVENTION

In recent years, from the viewpoints of a substantial increase in prices of crude oil and expected drying up of oil resources in the near future, the development of a high-depth oil field which has hitherto been disregarded, or an oil field or gas field, etc. in a severe corrosive environment that is a so-called sour environment containing hydrogen sulfide, etc. is eagerly performed. Steel pipes for oil country tubular goods which are used in such an environment are required to have such a material quality that they have both high strength and excellent corrosion resistance (sour resistance).

In response to such a requirement, for example, PTL 1 discloses a steel for oil country tubular goods having excellent sulfide stress corrosion cracking resistance, which is composed of a low alloy steel containing C: 0.2 to 0.35%, Cr: 0.2 to 0.7%, Mo: 0.1 to 0.5%, and V: 0.1 to 0.3% in terms of weight %, and in which the total amount of precipitated carbides and the proportion of an MC type carbide thereamong are prescribed.

In addition, PTL 2 discloses a steel material for oil country tubular goods having excellent sulfide stress corrosion cracking resistance, which contains C: 0.15 to 0.30%, Si: 0.05 to 1.0%, Mn: 0.10 to 1.0%, P: 0.025% or less, S: 0.005% or less, Cr: 0.1 to 1.5%, Mo: 0.1 to 1.0%, Al: 0.003 to 0.08%, N: 0.008% or less, B: 0.0005 to 0.010%, and Ca+O (oxygen): 0.008% or less in terms of mass %, and further contains one or more selected from Ti: 0.005 to 0.05%, Nb: 0.05% or less, Zr: 0.05% or less, and V: 0.30% or less, and in which with respect to properties of inclusions in steel, a maximum length of continuous non-metallic inclusions and the number of grains having a diameter of 20 μm or more are prescribed.

In addition, PTL 3 discloses a steel for oil country tubular goods having excellent sulfide stress corrosion cracking resistance, which contains C: 0.15 to 0.35%, Si: 0.1 to 1.5%, Mn: 0.1 to 2.5%, P: 0.025% or less, S: 0.004% or less, sol. Al: 0.001 to 0.1%, and Ca: 0.0005 to 0.005% in terms of mass %, and in which a Ca-based non-metallic inclusion composition and a composite oxide of Ca and Al are prescribed, and the hardness of the steel is prescribed by HRC.

The sulfide stress corrosion cracking resistance of steel as referred to in the technologies disclosed in these PTLs 1 to 3 means the presence or absence of the generation of SSC when immersing a round bar tensile specimen in a test bath described in NACE (an abbreviation of National Association of Corrosion Engineering) TM0177 for 720 hours while loading a specified stress according to the NACE TM0177 method A. On the other hand, in recent years, for the purpose of securing more safety of steel pipes for oil country tubular goods, a stress intensity factor $K_{ISSC}$ value a hydrogen sulfide-containing sour environment obtained by carrying out the DCB (double cantilever beam) test as prescribed according to the NACE TM0177 method D is being demanded to satisfy a prescribed value or more. The above-described prior art does not disclose a specific countermeasure for enhancing such a $K_{ISSC}$ value.

Meanwhile, PTL 4 discloses a low alloy steel for oil country tubular goods pipe with excellent sulfide stress corrosion cracking resistance having a yield strength of 861 MPa or more, which contains, in terms of mass %, C: 0.2 to 0.35%, Si: 0.05 to 0.5%, Mn: 0.05 to 1.0%, P: 0.025% or less, S: 0.01% or less, Al: 0.005 to 0.10%, Cr: 0.1 to 1.0%, Mo: 0.5 to 1.0%, Ti: 0.002 to 0.05%, V: 0.05 to 0.3%, B: 0.0001 to 0.005%, N: 0.01% or less, and O: 0.01% or less, and in which an equation between a half-value width of the [211] face and a hydrogen diffusion coefficient is prescribed to a predetermined value. This patent literature also describes the above-described $K_{ISSC}$ values in the working examples.

CITATION LIST

Patent Literature

PTL 1: JP-A-2000-178682
PTL 2: JP-A-2001-172739
PTL 3: JP-A-2002-60893
PTL 4: JP-A-2005-350754

SUMMARY OF THE INVENTION

However, almost all of the $K_{ISSC}$ values in the working examples of PTL 4 are concerned with an aqueous solution of (5 mass %, sodium chloride+0.5 mass % acetic acid) as saturated with a hydrogen sulfide gas at 0.1 atm (=0.01 MPa) (referred to as "bath A"). However, PTL 4 gives a few of working examples using an aqueous solution of (5 mass % sodium chloride+0.5 mass % acetic acid) as saturated with a hydrogen sulfide gas at 1 atm (=0.1 MPa) (referred to as "bath B) which is considered to be more disadvantageous with respect to the sulfide stress corrosion cracking, and it is unclear on what degree is a lower limit of scattering of the $K_{ISSC}$ value. In addition, on the occasion of using a seam steel pipe in the oil well or gas well, in general, the pipe and the pipe are joined by a screw system. At this time, a thick-walled member having a larger diameter than the size of a mainly used steel pipe, which is called a coupling, becomes necessary. Since the coupling is also exposed to the sour environment, it is required to be excellent in the sulfide stress corrosion cracking resistance (SSC resistance) similar to the main steel pipe. However, since this seamless steel pipe for coupling is thick in wall, it is difficult to achieve high strengthening, and in particular, it was difficult to realize a product of a 758 MPa grade in terms of yield strength.

In view of the foregoing problem, aspects of the present invention have been made, and an object thereof is to provide a low alloy high strength thick-walled seamless steel pipe for oil country tubular goods, which has a wall thickness of 40 mm or more and has excellent sulfide stress corrosion cracking resistance (SSC resistance) in a sour environment, while having a high strength of 758 MPa or more in terms of yield strength, and specifically, stably shows a high $K_{ISSC}$ value.

In order to solve the foregoing problem, the present inventors first collected every three or more DCB specimens having a thickness of 10 mm, a width of 25 mm, and a length of 100 mm from seamless steel pipes having various chemical compositions and micro structures of steel and having a yield strength of 758 MPa or more and a wall thickness of 44.5 to 56.1 mm on the basis of the NACE TM0177 method D and provided for a DCB test. As a test bath of the DCB test, an aqueous solution of (5 mass % NaCl+0.5 mass % $CH_3COOH$) of 24° C. as saturated with a hydrogen sulfide gas of 1.0 atm (0.1 MPa) was used. The DCB specimens into which a wedge had been introduced under a predetermined condition were immersed in this test bath for 336 hours, a length a of a crack generated in the DCB specimen during the immersion and a lift-off load P were then measured, and $K_{ISSC}$ (MPa√m) was calculated according to the following equation (2).

$$K_{ISSC}=\{Pa(2\sqrt{3}+2.38h/a)(B/B_n)^{1/\sqrt{3}}\}/Bh^{3/2} \quad (2)$$

Here, FIG. 1 is a schematic view of a DCB specimen. As shown in FIG. 1, h is a height of each arm of the DCB specimen; B is a thickness of the DCB specimen; and $B_n$ is a web thickness of the DCB specimen. For these, numerical values prescribed in the NACE TM0177 method D were used. A target of the $K_{ISSC}$ value was set to 26.4 MPa√m or more (24 ksi√inch or more) from a supposed maximum notch defect of oil country tubular goods and applied load condition. A graph resulting from sorting the obtained $K_{ISSC}$ values with an average hardness (Rockwell C scale hardness) of the seamless steel pipe provided with a specimen is shown in FIG. 2. It was noted that though the $K_{ISSC}$ values obtained by the DCB test tend to decrease with an increase of the hardness of the seamless steel pipe, the numerical values are largely scattered even at the same hardness.

As a result of extensive and intensive investigations regarding a cause of this scattering, it was determined that a degree of the scattering is different depending upon a stress-strain curve obtained when measuring the yield strength of steel pipe. FIG. 3 shows examples of the stress-strain curve. In the two stress-strain curves of steel pipe (a solid line A and a broken line B) shown in FIG. 3, though the stress values at a strain of 0.5 to 0.7% corresponding to the yield stress do not vary, one of them (broken line B) reveals continuous yielding, whereas the other (solid line A) reveals an upper yield point. Then, it was found that in the steel revealing the stress-strain curve (broken line B) of continuous yielding type, the scattering in the $K_{ISSC}$ value is large. The present inventors further made extensive and intensive investigations and sorted the dimensions of the scattering in the $K_{ISSC}$ value by a value ($\sigma_{0.7}/\sigma_{0.4}$) as a ratio of a stress ($\sigma_{0.7}$) at a strain of 0.7% to a stress ($\sigma_{0.4}$) at a strain of 0.4% in a stress-strain curve. As a result, it was found that as shown in FIG. 4, by regulating the ($\sigma_{0.7}/\sigma_{0.4}$) of seamless steel pipe to 1.02 or less (see black circles in the drawing), the scattering in the $K_{ISSC}$ value can be reduced as compared with the case where the ($\sigma_{0.7}/\sigma_{0.4}$) is more than 1.02 (see white circles in the drawing). As for the reason why when a value of the ratio of the stress ($\sigma_{0.7}$) at a strain of 0.7% to the stress ($\sigma_{0.4}$) at a strain of 0.4% in the stress-strain curve of seamless steel pipe is low, the scattering of the $K_{ISSC}$ value can be reduced, the following reason may be thought. That is, when a stress is given in a state where an initial notch is present as in the DCB test, there is a possibility that plastic deformation is caused at an end of the notch, and in the case where plastic deformation is caused, the sensitivity to sulfide stress corrosion cracking increases. On the other hand, as shown in FIG. 3, when the ($\sigma_{0.7}/\sigma_{0.4}$) is high, namely in a strain region of 0.4 to 0.7%, in the case of a steel having such tensile properties that continuous yielding is not yet revealed, plastic deformation of a notched end can be inhibited. Thus, the sensitivity to sulfide stress corrosion cracking does not change, and a high $K_{ISSC}$ value is stably obtained.

In order to stably regulate the ($\sigma_{0.7}/\sigma_{0.4}$) of seamless steel pipe to 1.02 or less, in addition to limitation of a chemical composition of steel as described later, it is required to regulate a micro structure of steel to martensite such that the stress-strain curve is not made a continuous yielding type, to suppress the formation of a micro structure other than martensite as far as possible, and further to increase a quenching temperature during quenching to solid-solve Mo as far as possible for the purpose of increasing a secondary precipitation amount of Mo. With respect to the above-described secondary precipitation amount, precipitated Mo having been precipitated before quenching is defined as a primary precipitate, and precipitated Mo that is solid-solved during quenching and precipitated after tempering is defined as a secondary precipitate.

Meanwhile, in order to increase the $\sigma_{0.4}$ value, it is required to subject the crystal grains to grain refining, and conversely, the quenching temperature is preferably lower. In order to make the both compatible with each other, in producing a seamless steel pipe, first, the rolling finishing temperature of hot rolling for forming a steel pipe is increased, and after finishing of rolling, direct quenching (also referred to as "DQ"; DQ refers to the matter that at the finishing stage of hot rolling, quenching is immediately performed from a state where the steel pipe temperature is still high) is applied. That is, when the rolling finishing temperature is increased to once solid-solve Mo as far as possible, and thereafter, the quenching temperature during quenching and tempering heat treatment of steel pipe is lowered, both the increase of the above-described secondary precipitation amount of Mo and the grain refining of the crystal grains are made compatible with each other, whereby the ($\sigma_{0.7}/\sigma_{0.4}$) can be stably regulated to 1.02 or less. In addition, after hot rolling of steel pipe, in the case where DQ is not applicable, by performing the quenching and tempering heat treatment plural times, in particular, by making the initial quenching temperature high as 1,000° C. or higher, the effect of DQ can be substituted.

Furthermore, as a result of extensive and intensive investigations made by the present inventors, it has been found that by controlling segregation of Mo of the Steel pipe raw material, even when the wall thickness is 40 mm or more, with respect to the $K_{ISSC}$ value, the target 26.4 MPa√m or more can be more stably realized.

As shown in FIG. 5, in a longitudinal orthogonal cross section of a steel pipe, a cross-sectional overall thickness sample of a representative one place in the circumferential direction was collected, and quantitative planar analysis of Mo was performed with an electron probe micro analyzer (EPMA). As for measurement conditions of EPMA, an accelerating voltage was set to 20 kV, a beam current was set to 0.5 μA, and a beam diameter was set to 10 μm; the measurement was performed at 6,750,000 points in all of a rectangular region in the wall thickness direction of 45 mm and the circumferential direction of 15 mm; and a Mo concentration (mass %) was converted using a calibration curve prepared in advance from a characteristic X-ray strength of Mo—K shell excitation. FIG. 5 shows a Mo concentration distribution map within the measurement plane. A region with deep color is a Mo-concentrated part. As a result of microhardness measurement, it has become clear that in such a Mo-concentrated part, the hardness of steel increases to 1.1 times at maximum. Then, it has been noted that in a local hardened area following the Mo segregation, the $K_{ISSC}$ value decreases. In particular, in a thick-walled steel pipe, the Mo content is high for the purpose of securing a high strength, and the generation of a low $K_{ISSC}$ value due to such Mo segregation becomes remarkable. Thus, the present inventors have made an effort for reducing such a Mo-segregated part existing in a thick-walled steel pipe and simultaneously investigated derivation of an index of segregation sufficient for suppressing the generation of a local low $K_{ISSC}$ value.

Then, the present inventors statistically treated values obtained by dividing a Mo concentration value (EPMA Mo value) of an individual measurement point at the time of the above-described EPMA quantitative planar analysis measurement by an average Mo concentration (EPMA Mo ave.) of all of the measurement points and then prepared a cumulative frequency rate graph as shown in FIG. 6. Then, the present inventors have found that in this cumulative frequency rate graph, when the cumulative frequency rate vs. the (EPMA Mo value)/(EPMA Mo ave.) (hereinafter also referred to as "Mo segregation degree") of 1.5 or more is 1% or less (black circles in the drawing), not only the generation of a low $K_{ISSC}$ value is suppressed as shown in FIG. 7 (black circles in the drawing), but also, the scattering of the $K_{ISSC}$ value is small, whereby 26.4 MPa√m or more is stably achieved.

In order that the cumulative frequency rate at which the Mo segregation degree is 1.5 or more may be regulated to 1% or less, it is preferred that by holding a bloom after bloom casting is held at a high temperature for a long period of time, the Mo atom is diffused in a solid. Specifically, it is preferred to hold the bloom at 1,100° C. or higher for at least 5 hours or more. With respect to this long-term holding at a high temperature, as compared with the case where the holding is carried out on the occasion of billet heating in hot rolling during forming a material prepared by continuously casting into a billet having a round cross section directly by continuous casting equipment or the like into a seamless steel pipe, in the case where on the occasion of once continuously casting the material in a bloom having a rectangular cross section and forming the bloom in a billet having a round cross section by means of hot rolling, the holding of the bloom is carried out at a high temperature for a long period of time, specifically the holding is carried out at 1,200° C. or higher for 20 hours or more, it becomes unnecessary to perform billet heating during hot rolling of seamless steel pipe forming at a high temperature for a long period of time, and coarsening of crystal grains is suppressed, so that the ($\sigma_{0.4}$) value is relatively increased, whereby the ($\sigma_{0.7}/\sigma_{0.4}$) can be stably regulated to 1.02 or less. Therefore, such is effective.

In the case where the bloom continuous casting equipment or the hot rolling equipment for forming a bloom slab into a billet having a round cross section is not provided, when high-temperature heating in which coarsening of crystal grains is permissible on the occasion of billet heating in hot rolling during seamless steel pipe forming, specifically heating at 1,250° C. or higher and 1,270° C. or lower is carried out, and furthermore, prior to the quenching and tempering treatment of steel pipe, by performing normalizing (N) treatment in which the resultant is heated at 1,100° C. or higher and then held for at least 5 hours or more, followed by air cooling, the effect of diffusion of Mo segregation obtained by round billet rolling after holding the bloom at a high temperature for a long period of time can be substituted.

In the foregoing way, a high $K_{ISSC}$ value can be stably obtained while highly strengthening a thick-walled seamless steel pipe that is used in a hydrogen sulfide-containing sour environment.

Aspects of the present invention have been accomplished on the basis of such findings and has the following gist.

[1] A low alloy high strength thick-walled seamless steel pipe for oil country tubular goods having a wall thickness of 40 mm or more and a yield strength of 758 MPa or more, the steel pipe comprising a composition containing, in terms of mass %,
C: 0.25 to 0.31%,
Si: 0.01 to 0.35%,
Mn: 0.55 to 0.70%,
P: 0.010% or less,
S: 0.001% or less,
O: 0.0015% or less,
Al: 0.015 to 0.040%,
Cu: 0.02 to 0.09%,
Cr: 0.8 to 1.5%,
Mo: 0.9 to 1.6%,
V: 0.04 to 0.10%,
Nb: 0.005 to 0.05%,
B: 0.0015 to 0.0030%,
Ti: 0.005 to 0.020%, and
N: 0.005% or less,
and having a value of a ratio of the Ti content to the N content (Ti/N) of 3.0 to 4.0,
with the balance being Fe and inevitable impurities,
wherein a cumulative frequency rate is 1% or less in view of measurement points at which a Mo segregation degree is 1.5 or more which is measured in an overall thickness of a longitudinal orthogonal cross section of the pipe, as defined by the following expression (A); and
the steel pipe has a value ($\sigma_{0.7}/\sigma_{0.4}$), as a ratio of a stress at a strain of 0.7% to a stress at a strain of 0.4% in a stress-strain curve, of 1.02 or less:

$$\text{Mo segregation degree}=(\text{EPMA Mo value})/(\text{EPMA Mo ave.}) \quad (A)$$

wherein
the (EPMA Mo value) is a Mo concentration value (mass %) of an individual measurement point at the time of the EPMA quantitative planar analysis measurement; and
the (EPMA Mo ave.) is an average Mo concentration (mass %) of all of the measurement points at the time of the EPMA quantitative planar analysis measurement.

[2] The low alloy high strength thick-walled seamless steel pipe for oil country tubular goods as set forth in the item [1], which further contains, in addition to the composition, one or more selected from, in terms of mass %,
W: 0.1 to 0.2%, and
Zr: 0.005 to 0.03%.

[3] The low alloy high strength thick-walled seamless steel pipe for oil country tubular goods as set forth in the item [1] or [2], which further contains, in addition to the composition, in terms of mass %, Ca: 0.0005 to 0.0030%, and has the number of oxide-based non-metallic inclusions in steel comprising of Ca and Al and having a maximum bulk size of 5 μm or more, whose composition ratio satisfies, in terms of mass %, the following equation (1), of 20 or less per 100 $mm^2$:

$$(CaO)/(Al_2O_3) \geq 4.0 \quad (1)$$

The term "high strength" referred to herein refers to a case of having a strength of 758 MPa or more (110 ksi or more) in terms of yield strength, and the term "thick-walled" refers to a case where a wall thickness of the steel pipe is 40 mm or more. Although an upper limit value of the yield strength is not particularly limited, it is preferably 950 MPa. In addition, though an upper limit value of the wall thickness is not particularly limited, too, it is preferably 60 mm.

In addition, the low alloy high strength seamless steel pipe for oil country tubular goods according to aspects of the present invention is excellent in sulfide stress corrosion cracking resistance (SSC resistance). What the sulfide stress corrosion cracking resistance is excellent refers to the matter that when a DCB test using, as a test bath, a mixed aqueous solution of 5 mass % of NaCl and 0.5 mass % of $CH_3COOH$ of 24° C. as saturated with a hydrogen sulfide gas of 1 atm (0.1 MPa), that is a DCB test according to the NACE TM0177 method D, is performed three times, $K_{ISSC}$ obtained according to the above-described equation (1) is stably 26.4 MPa√m or more in all of the three-times test.

In accordance with aspects of the present invention, it is possible to provide a low alloy high strength thick-walled seamless steel pipe for oil country tubular goods having excellent sulfide stress corrosion cracking resistance (SSC resistance) in a hydrogen sulfide gas-saturated environment (sour environment), while having a high strength of 758 MPa or more in terms of yield strength, and in particular, stably showing a high $K_{ISSC}$ value. This steel pipe can be used as a low alloy high strength thick-walled seamless steel pipe for coupling.

DETAILED DESCRIPTION OF EMBODIMENTS OF THE INVENTION

Figure 1:
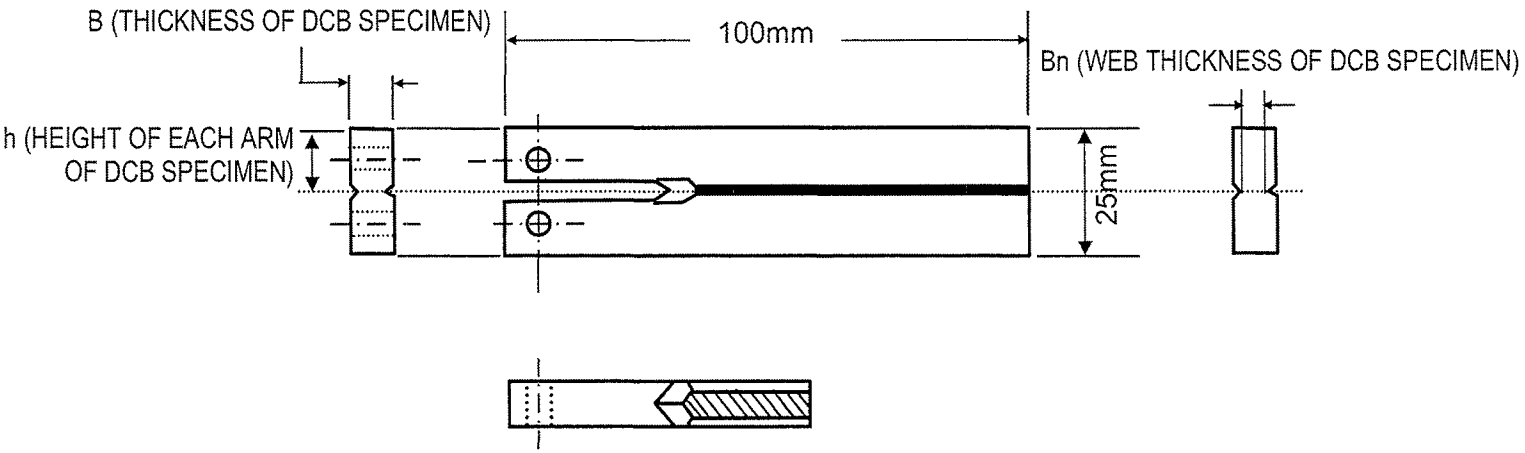
FIG. 1 is a schematic view of a DCB specimen.
Figure 2:
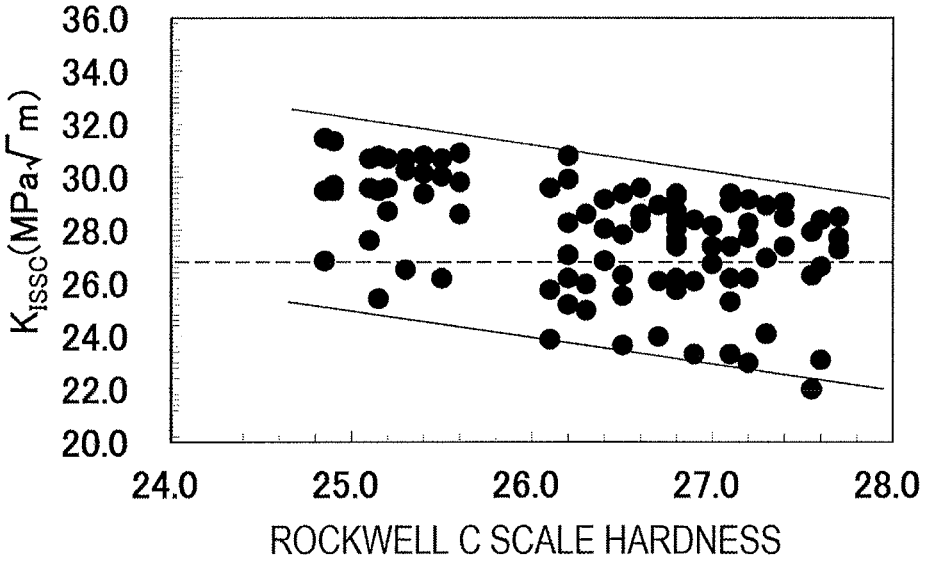
FIG. 2 is a graph showing a relation between hardness and $K_{ISSC}$ value of a steel pipe.
Figure 3:
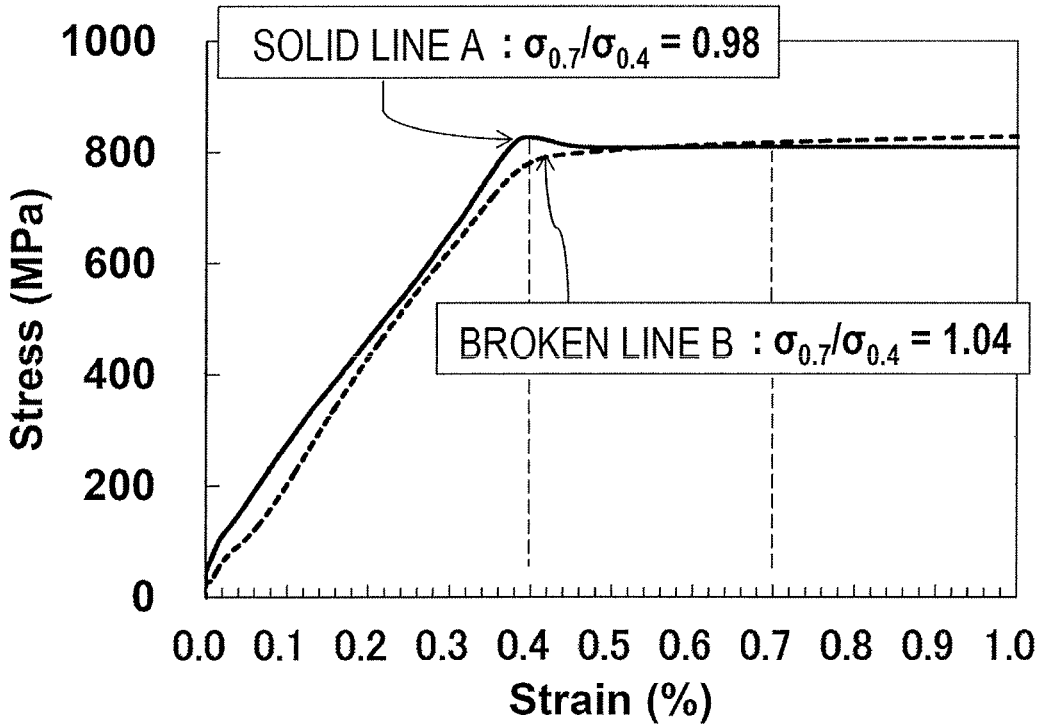
FIG. 3 is a graph showing a stress-strain curve of steel pipes having a different scattering in the $K_{ISSC}$ value.
Figure 4:
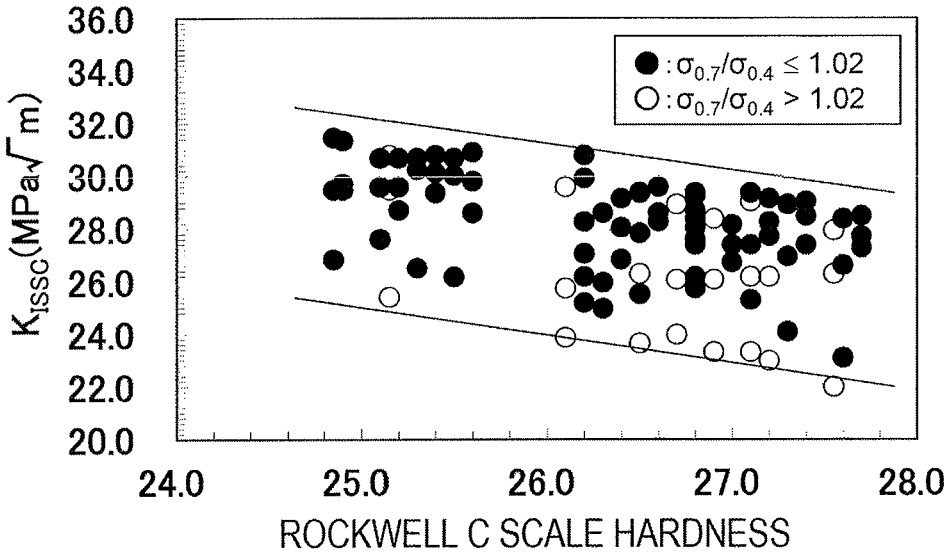
FIG. 4 is a graph showing the matter that by regulating $(\sigma_{0.7}/\sigma_{0.4})$ obtained from the stress-strain curve of steel pipe to 1.02 or less, a scattering in the $K_{ISSC}$ value decreases.
Figure 5:
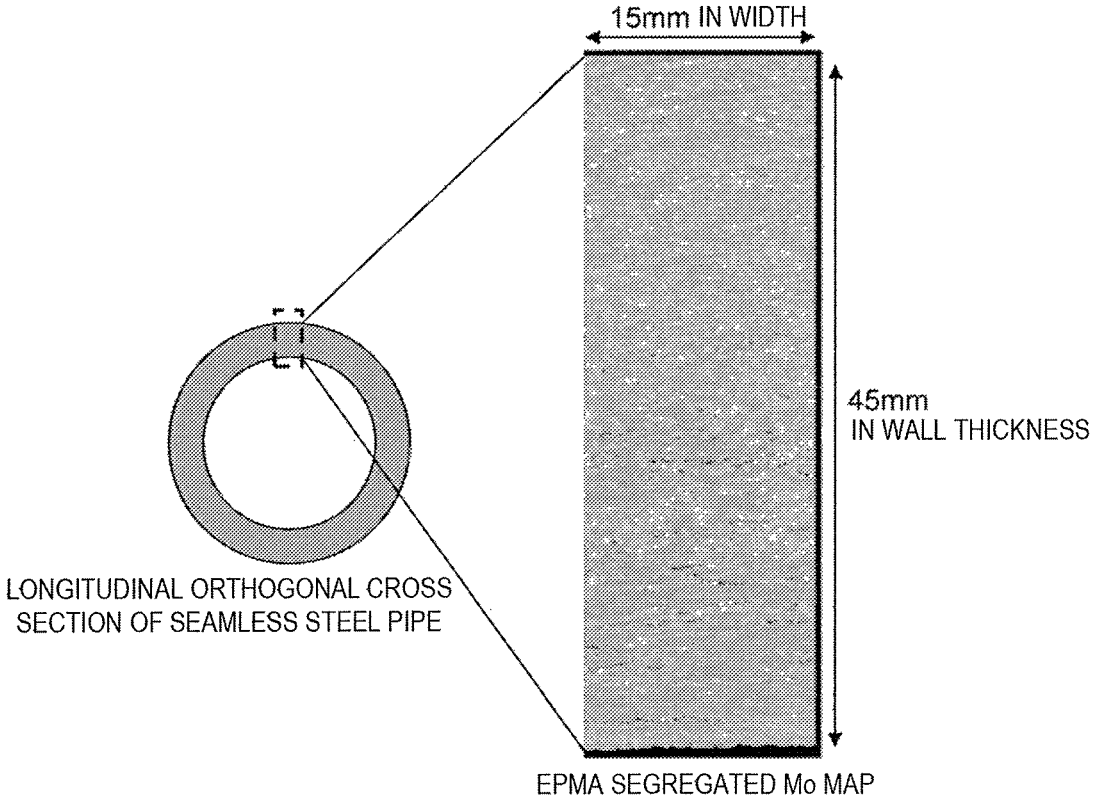
FIG. 5 is a map showing a segregated Mo measurement region in a longitudinal orthogonal cross section of a steel pipe and a Mo concentration distribution measured by an electron probe micro analyzer (EPMA).
Figure 6:
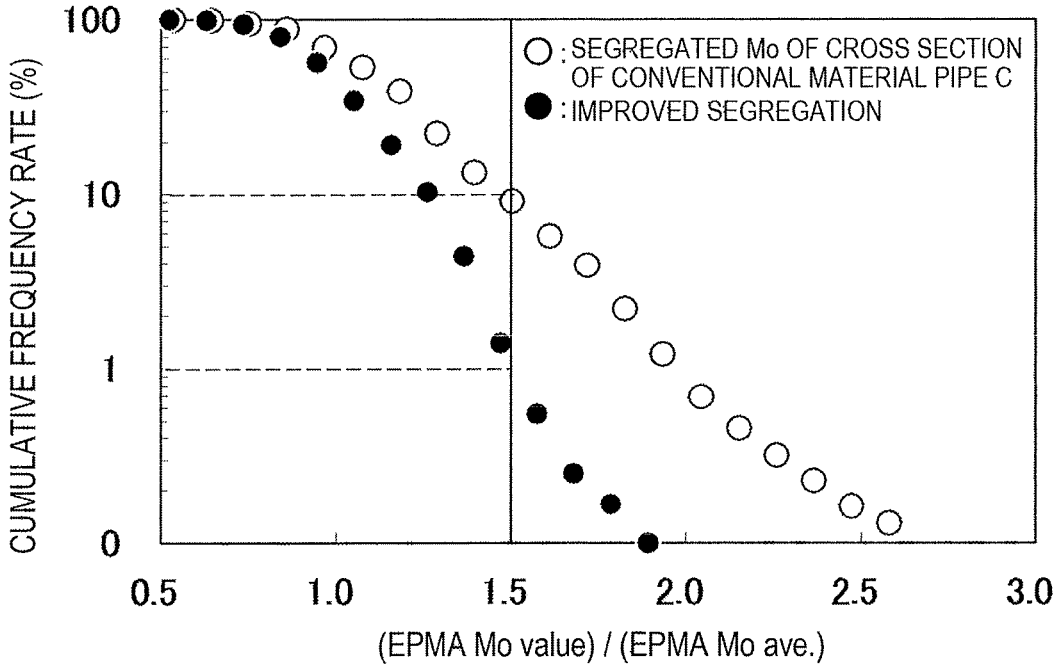
FIG. 6 is a graph showing a cumulative frequency rate of a value obtained by dividing an individual Mo value measured by an electron probe micro analyzer (EPMA) by an average value of all of the measurement points.
Figure 7:
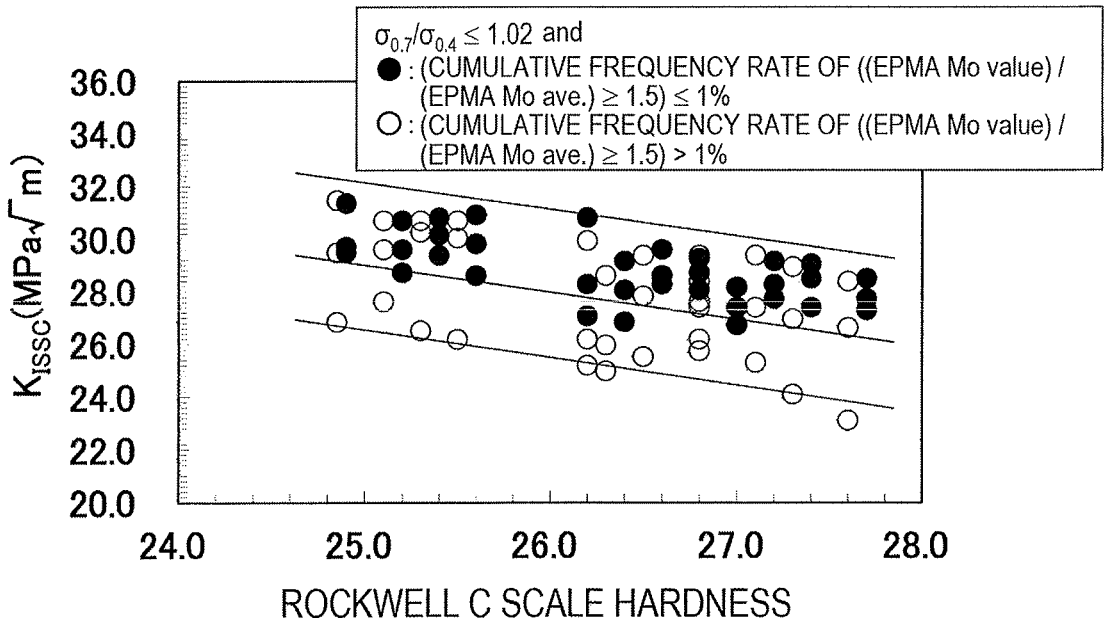
FIG. 7 is a graph showing the matter that when the cumulative frequency rate vs. the Mo segregation degree of 1.5 or more is 1% or less, the scattering of the $K_{ISSC}$ value is reduced.

The steel pipe according to aspects of the present invention is a low alloy high strength thick-walled seamless steel pipe for oil country tubular goods having a wall thickness of 40 mm or more and a yield strength of 758 MPa or more, the steel pipe comprising a composition containing, in terms of mass %, C: 0.25 to 0.31%, Si: 0.01 to 0.35%, Mn: 0.55 to 0.70%, P: 0.010% or less, S: 0.001% or less, O: 0.0015% or less, Al: 0.015 to 0.040%, Cu: 0.02 to 0.09%, Cr: 0.8 to 1.5%, Mo: 0.9 to 1.6%, V: 0.04 to 0.10%, Nb: 0.005 to 0.05%, B: 0.0015 to 0.0030%, Ti: 0.005 to 0.020%, and N: 0.005% or less, and having a value of a ratio of the Ti content to the N content (Ti/N) of 3.0 to 4.0, with the balance being Fe and inevitable impurities, wherein a cumulative frequency rate at a measurement point at which a Mo segregation degree in an overall thickness of a longitudinal orthogonal cross section of the pipe, as defined by the following expression (A), is 1.5 or more is 1% or less, and the steel pipe has a value $(\sigma_{0.7}/\sigma_{0.4})$, as a ratio of a stress at a strain of 0.7% to a stress at a strain of 0.4% in a stress-strain curve, of 1.02 or less:

$$\text{Mo segregation degree} = (\text{EPMA Mo value})/(\text{EPMA Mo ave.}) \quad (A)$$

wherein the (EPMA Mo value) is a Mo concentration value (mass %) of an individual measurement point at the time of the EPMA quantitative planar analysis measurement; and the (EPMA Mo ave.) is an average Mo concentration (mass %) of all of the measurement points at the time of the EPMA quantitative planar analysis measurement.

First of all, the reason for limiting the chemical composition of the steel pipe according to aspects of the present invention is described. The term "mass %" is hereinafter referred to simply as "%" unless otherwise indicated.

C: 0.25 to 0.31%

C has a function of increasing the strength of steel and is an important element for securing the desired high strength. In addition, C is an element for improving quenching hardenability, and in particular, in a thick-walled seamless steel pipe having a wall thickness of 40 mm or more, in order, to realize high strengthening to such an extent that the yield strength is 758 MPa or more, it is required to contain C of 0.25% or more. On the other hand, when the content of C exceeds 0.31%, a remarkable increase of $(\sigma_{0.7}/\sigma_{0.4})$ is caused, and a scattering in the $K_{ISSC}$ value becomes large. For this reason, the content of C is limited to 0.25 to 0.31%. The content of C is preferably 0.29% or less.

Si: 0.01 to 0.35%

Si is an element functioning as a deoxidizer and having a function of increasing the strength of steel upon being solid-solved in steel and suppressing rapid softening during tempering. In order to obtain such an effect, it is required to contain Si of 0.01% or more. On the other hand, when the content of Si exceeds 0.35%, coarse oxide-based inclusions are formed, and a scattering in the $K_{ISSC}$ value becomes large. For this reason, the content of Si is limited to 0.01 to 0.35%, and preferably 0.01 to 0.04%.

Mn: 0.55 to 0.70%

Mn is an element having a function of increasing the strength of steel through an improvement in quenching hardenability and of preventing grain boundary embrittlement to be caused due to S by bonding to S and fixing S as MnS, and in particular, in a thick-walled seamless steel pipe having a wall thickness of 40 mm or more, in order to realize high strengthening to such an extent that the yield strength is 758 MPa or more, it is required to contain Mn of 0.55% or more. On the other hand, when the content of Mn exceeds 0.70%, a remarkable increase of $(\sigma_{0.7}/\sigma_{0.4})$ is caused, and a scattering in the $K_{ISSC}$ value becomes large. For this reason, the content of Mn is limited to 0.55 to 0.70%. The content of Mn is preferably 0.55 to 0.65%.

P: 0.010% or less

P shows a tendency to segregate in grain boundaries or the like in a solid-solution state and to cause grain boundary embrittlement cracking or the like, and is thus desirably decreased in amount as far as possible. However, the content of up to 0.010% is permissible. Thus, the content of P is limited to 0.010% or less.

S: 0.001% or less

S is mostly present as sulfide-based inclusions in steel and decreases ductility, toughness, and corrosion resistance, such as sulfide stress corrosion cracking resistance, etc. There is a case where S is partially present in a solid-solution state; in this case, however, S shows a tendency to segregate in grain boundaries or the like and to cause grain boundary embrittlement cracking or the like. Thus, it is desired to decrease S as far as possible. However, an excessive decrease in amount rapidly increases smelting costs. Thus, in accordance with aspects of the present invention, the content of S is limited to 0.001% or less at which adverse effects are permissible.

O (oxygen): 0.0015% or less

O (oxygen) is an inevitable impurity and is present as oxides of Al, Si, and so on in the steel. In particular, when the number of coarse oxides thereof is large, a scattering in the $K_{ISSC}$ value is caused to become large. For this reason, the content of O (oxygen) is limited to 0.0015% or less at which adverse effects are permissible. The content of O (oxygen) is preferably 0.0010% or less.

Al: 0.015 to 0.040%

Al functions as a deoxidizer and contributes to a decrease of solid-solved N by bonding to N to form AlN. In order to obtain such an effect, it is required to contain Al of 0.015% or more. On the other hand, when the content of Al exceeds 0.040%, oxide-based inclusions increase, thereby making a scattering in the $K_{ISSC}$ value large. For this reason, the content of Al is limited to 0.015 to 0.040%. The content of Al is preferably 0.020% or more, and preferably 0.030% or less.

Cu: 0.02 to 0.09%

Cu is an element having a function of improving the corrosion resistance, and when a minute amount thereof is added, a dense corrosion product is formed, the formation and growth of pits serving as a starting point of SSC are suppressed, and the sulfide stress corrosion cracking resistance is remarkably improved. Thus, in accordance with aspects of the present invention, it is required to contain Cu of 0.02% or more. On the other hand, when the content of Cu exceeds 0.09%, the hot workability during a production process of seamless steel pipe is deteriorated. For this reason, the content of Cu is limited to 0.02 to 0.09%. The content of Cu is preferably 0.03% or more, and preferably 0.05% or less.

Cr: 0.8 to 1.5%

Cr is an element which contributes to an increase in the strength of steel through an improvement in quenching hardenability and improves the corrosion resistance. In addition, Cr bonds to C to form carbides, such as $M_3C$-based, $M_7C_3$-based, and $M_{23}C_6$-based carbides, etc., during tempering. In particular, the $M_3C$-based carbide improves the resistance of softening by tempering of steel, decreases a change in strength to be caused due to tempering, and contributes to an improvement of the yield strength. In order to achieve the yield strength of 758 MPa or more, it is required to contain Cr of 0.8% or more. On the other hand, even when the content of Cr exceeds 1.5%, the effect is saturated, so that such is economically disadvantageous. For this reason, the content of Cr is limited to 0.8 to 1.5%. The content of Cr is preferably 0.9% or more, and preferably 1.3% or less.

Mo: 0.9 to 1.6%

Mo is an element which contributes to an increase in the strength of steel through an improvement in quenching hardenability and improves the corrosion resistance. With respect to this Mo, the present inventors paid attention especially to a point of forming an $M_2C$-based carbide. In addition, Mo has such an effect that Mo forms the $M_2C$-based carbide, and in particular, the $M_2C$-based carbide to secondarily precipitate after tempering improves the resistance of softening by tempering of steel, decreases a change in strength to be caused due to tempering, contributes to an improvement of the yield strength, and converts the shape of stress-strain curve of steel from a continuous yielding type to a yielding type. In particular, in the thick-walled seamless steel pipe having a wall thickness of 40 mm or more, in order to obtain such an effect, it is required to contain Mo of 0.9% or more. On the other hand, when the content of Mo exceeds 1.6%, the $Mo_2C$-based carbide becomes coarse and serves as a starting point of the sulfide stress corrosion cracking, thereby rather causing a decrease of the $K_{ISSC}$ value. For this reason, the content of Mo is limited to 0.9 to 1.6%. The content of Mo is preferably 0.9 to 1.5%.

V: 0.04 to 0.10%

V is an element which forms a carbide or a nitride and contributes to strengthening of steel. In particular, in the thick-walled seamless steel pipe having a wall thickness of 40 mm or more, in order to obtain such an effect, it is required to contain V of 0.04% or more. On the other hand, when the content of V exceeds 0.10%, a V-based carbide is coarsened and becomes a starting point of the sulfide stress corrosion cracking, thereby rather causing a decrease of the $K_{ISSC}$ value. For this reason, the content of V is limited to a range of 0.04 to 0.10%. The content of V is preferably 0.045% or more, and preferably 0.055% or less.

Nb: 0.005 to 0.05%

Nb is an element which delays recrystallization in an austenite (γ) temperature region to contribute to refining of γ grains and significantly functions in refining of a lower substructure (for example, a packet, a block, or a lath) of steel immediately after quenching. In order to obtain such an effect, it is required to contain Nb of 0.005% or more. On the other hand, even when the content of Nb exceeds 0.05%, precipitation of a coarse precipitate (NbN) is promoted, resulting in deteriorating of the sulfide stress corrosion cracking resistance. For this reason, the content of Nb is limited to 0.005 to 0.05%. The packet as referred to herein is defined as a region composed of a group of laths arranged in parallel and having the same crystal habit plane, and the block is composed of a group of parallel laths having the same orientation. The content of Nb is preferably 0.008% or more, and preferably 0.45% or less.

B: 0.0015 to 0.0030%

B is an element which contributes to an improvement in quenching properties at a slight content, and in accordance with aspects of the present invention, it is required to contain B of 0.0015% or more. On the other hand, even when the content of B exceeds 0.0030%, the effect is saturated, or conversely, a desired effect cannot be expected due to the formation of an Fe boride (Fe—B), so that such is economically disadvantageous. For this reason, the content of B is limited to 0.0015 to 0.0030%. The content of B is preferably 0.0020% to 0.0030%.

Ti: 0.005 to 0.020%

Ti forms a nitride and decreases excessive N in the steel, thereby making the above-described effect of B effective. In addition, Ti is an element which contributes to prevention of coarsening to be caused due to a pinning effect of austenite grains during quenching of steel. In order to obtain such an effect, it is required to contain Ti of 0.005% or more. On the other hand, when the content of Ti exceeds 0.020%, the formation of a coarse MC-type nitride (TiN) is accelerated during casting, resulting in rather coarsening of austenite grains during quenching. For this reason, the content of Ti is limited to 0.005 to 0.020%. The content of Ti is preferably 0.009% or more, and preferably 0.016% or less.

N: 0.005% or less

N is an inevitable impurity in steel and bonds to an element which forms a nitride of Ti, Nb, Al, or the like, to form an MN-type precipitate. Furthermore, excessive N remaining after forming such a nitride also bonds to B to form a BN precipitate. On this occasion, the effect for improving quenching hardenability due to the addition of B is lost, and therefore, it is preferred that the excessive N is decreased as far as possible. The content of N is limited to 0.005% or less.

Ratio of Ti Content to N Content (Ti/N): 3.0 to 4.0

In order that both the pinning effect of austenite grains due to the formation of a TiN nitride by the addition of Ti and the effect for improving quenching hardenability due to the addition of B through prevention of the BN formation due to suppression of excessive N may be made compatible with each other, the Ti/N is prescribed. In the case where the Ti/N is lower than 3.0, the excessive N is generated, and BN is formed, so that the solid-solved B during quenching is insufficient. As a result, the micro structure at the finishing of quenching becomes a multi-phase structure of martensite and bainite, or martensite and ferrite, and the strain-stress curve after tempering such a multi-phase structure becomes a continuous yielding type, whereby the value of $(\sigma_{0.7}/\sigma_{0.4})$ largely increases. On the other hand, in the case where the Ti/N exceeds 4.0, the pinning effect of austenite grains is deteriorated due to coarsening of TiN, and the required fine grain structure is not obtained. For this reason, the Ti/N is limited to 3.0 to 4.0.

The balance other than the above-described components is Fe and inevitable impurities. In addition to the above-described basic composition, one or more selected from W: 0.1 to 0.2% and Zr: 0.005 to 0.03% may be selected and contained, if desired. In addition to the above, Ca of 0.0005 to 0.0030% may be contained, and the number of oxide-based non-metallic inclusions in steel comprising of Ca and Al and having a major diameter of 5 μm or more, whose composition ratio satisfies a relation: $(CaO)/(Al_2O_3) \geq 4.0$, in terms of mass %, may be 20 or less per 100 $mm^2$.

W: 0.1 to 0.2%

Similar to Mo, W forms a carbide to contribute to an increase in strength due to precipitation hardening, and segregates, in a solid solution, in prior-austenite grain boundaries, thereby contributing to an improvement in the sulfide stress corrosion cracking resistance. In order to obtain such an effect, it is desired to contain W of 0.1% or more. However, when the content of W exceeds 0.2%, the resistance to sulfide stress corrosion cracking is deteriorated. For this reason, in the case where W is contained, the content of W is limited to 0.1 to 0.2%.

Zr: 0.005 to 0.03%

Similar to Ti, Zr forms a nitride and is effective for suppressing the growth of austenite grains during quenching due to a pinning effect. In order to obtain the required effect, it is desired to contain Zr of 0.005% or more. On the other hand, even when the content of Zr exceeds 0.03%, the effect is saturated. For this reason, the content of Zr is limited to 0.005 to 0.03%.

Ca: 0.0005 to 0.0030%

Ca is effective for preventing nozzle clogging during continuous casting. In order to obtain the required effect, it is desired to contain Ca of 0.0005% or more. On the other hand, Ca forms an oxide-based non-metallic inclusion complexed with Al, and in particular, in the case where the content of Ca exceeds 0.0030%, a large number of coarse oxide-based non-metallic inclusions are present, thereby deteriorating the resistance to sulfide stress corrosion cracking. Specifically, in view of the fact that inclusions in which a composition ratio of the Ca oxide (CaO) to the Al oxide ($Al_2O_3$) satisfies the equation (1) in terms of mass % especially give adverse effects, it is desired to regulate the number of inclusions having a maximum bulk size of 5 μm or more and satisfying the equation (1) to 20 or less per 100 $mm^2$. The number of inclusions can be calculated in the following manner. That is, from an optional one place in the circumferential direction of an end of a steel pipe, a sample for scanning electron microscope (SEM) of a longitudinal orthogonal cross section of the pipe is collected, and with respect to this sample, at least three places of the pipe outer surface, wall thickness center, and inner surface are subjected to SEM observation of inclusions, a chemical composition is analyzed with a characteristic X-ray analyzer annexed to the SEM, and the number of inclusions is calculated from the analysis results. For this reason, in the case where Ca is contained, the content of Ca is limited to 0.0005 to 0.0030%. In addition, in this case, the number of oxide-based non-metallic inclusions in steel comprising of Ca and Al and having a maximum bulk size of 5 μm or more, whose composition ratio satisfies, in terms of mass %, the following equation (1), is limited to 20 or less per 100 $mm^2$. The content of Ca is preferably 0.0010% or more, and preferably 0.0016% or less.

$$(CaO)/(Al_2O_3) \geq 4.0 \quad (1)$$

The above-described number of inclusions can be controlled by controlling the charged amount of Al during Al-killed treatment to be performed after finishing of decarburization refining and the addition of Ca in an amount in conformity with the analyzed values of Al, O, and Ca in a molten steel before the addition of Ca.

In accordance with aspects of the present invention, though it is not particularly needed to limit the production method of a steel pipe raw material having the above-described composition, it is preferred that a molten steel having the above-described composition is refined by a usually known refining method using a converter, an electric furnace, a vacuum melting furnace, or the like, once cast into a bloom having a rectangular cross section by a continuous casting method, an ingot making-blooming method, or the like, and the bloom is subjected to temperature equalization at 1,250° C. or higher for 20 hours or more, and is subsequently formed into a billet having a round cross section as a steel pipe raw material by means of hot rolling, thereby reducing the Mo segregation. The steel pipe raw material is formed into a seamless steel pipe by a hot forming. In the hot forming method, after piercer perforation, the steel pipe raw material is formed in a predetermined thickness by any method of mandrel mill rolling and plug mill rolling, and thereafter, hot rolling is performed until appropriate diameter-reducing rolling. In order to stably regulate the ($\sigma_{0.7}/\sigma_{0.4}$) to 1.02 or less, it is desired to carry out direct quenching (DQ) after hot rolling. Furthermore, it is required to prevent occurrence of the matter that when the micro structure at the finishing of this DQ becomes a multi-phase structure of martensite and bainite, or martensite and ferrite, after the subsequent quenching and tempering heat treatment, the crystal grain diameter of steel and the secondary precipitation amount of Mo or the like become heterogeneous, whereby the value of ($\sigma_{0.7}/\sigma_{0.4}$) does not become stable. For that reason, in order that the commencement of DQ may be performed from an austenite single phase region, the finishing temperature of hot rolling is preferably at 950° C. or higher. On the other hand, the finishing temperature of DQ is preferably 200° C. or lower. After forming the seamless steel pipe, in order to achieve the target yield strength of 758 MPa or more, quenching (Q) and tempering (T) of the steel pipe are carried out. From the viewpoint of grain refining of crystal grains of steel, it is preferred that the quenching and tempering heat treatment is repeatedly carried out at least two times. At this time, from the viewpoint of grain refining, the quenching temperature is preferably set to 930° C. or lower. On the other hand, in the case where the quenching temperature is lower than 860° C., solid-solution of Mo or the like is insufficient, so that the secondary precipitation amount after finishing of the subsequent tempering cannot be secured. For this reason, the quenching temperature is preferably set to 860 to 930° C. In order to avoid re-transformation of austenite, the tempering temperature is required to be an $Ac_1$ temperature or lower; however, when it is lower than 650° C., the secondary precipitation amount of Mo or the like cannot be secured. For this reason, it is preferred to set the tempering temperature to at least 650° C. or higher.

In the case where forming of a billet having a round cross section by means of hot rolling after the bloom temperature equalization, DQ after hot rolling of the billet, or the like cannot be carried out due to equipment restriction, by carrying out billet heating at a higher temperature than a temperature in the usual method at the time of hot rolling for forming into a seamless steel pipe and performing a normalizing (N) treatment in which prior to carrying out the quenching and tempering heat treatment, the steel pipe air-cooled after hot rolling is heated at 1,100° C. or higher and held for at least 5 hours, followed by air cooling, the Mo segregation reducing effect by the above-described bloom temperature equalization can be substituted.

Next, the properties of the steel pipe according to aspects of the present invention are described.

A cumulative frequency rate at which a Mo segregation degree in an overall thickness of a longitudinal orthogonal cross section of the pipe is 1.5 or more is 1% or less.

As described previously, the segregation of Mo affects a lowering of the $K_{ISSC}$ value. In order to quantify this segregation of Mo, the present inventors have derived a method in which a Mo segregation state capable of suppressing a lowering of the $K_{ISSC}$ value is defined according to a cumulative frequency rate graph that is obtained by defining a value obtained by dividing a Mo concentration (EPMA Mo value) of an individual measurement point obtained by the EPMA planar analysis by an average Mo concentration (EPMA Mo ave.) of all of the measurement points as a Mo segregation degree and statically treating this Mo segregation degree. Then, when the Mo segregation degree is 1.5 or more, an increase of a local hardness of the segregated part is remarkable; however, when its cumulative frequency rate is 1% or less, the influence against the $K_{ISSC}$ value substantially disappears. Therefore, in accordance with aspects of the present invention, the cumulative frequency rate at a measurement point at which the Mo segregation degree is 1.5 or more is limited to 1% or less. The reduction of the segregation of Mo can be achieved by a method in which the steel pipe raw material is not cast directly into a round billet, but the steel pipe raw material is once formed into a bloom, and the bloom is subjected to temperature equalization at a high temperature for a long period of time, followed by forming into a round billet by means of hot rolling; a method in which even in the case of a directly cast billet, a seamless steel pipe is subjected to hot rolling, and then, prior to quenching and tempering, is subjected to normalizing treatment for a long period of time; or the like. In the EPMA measurement, an overall thickness sample of a longitudinal orthogonal cross section of the pipe collected from an optional one place of a pipe end sample collected at the stage at which the final tempering is finished in the circumferential direction is used, and its measurement region is defined as a rectangular region defined by the whole of the wall thickness direction and the circumferential direction corresponding to about ⅓ of the wall thickness. As for measurement conditions of EPMA, an accelerating voltage is set to 20 kV, a beam current is set to 0.5 μA, and a beam diameter is set to 10 μm. The above-described rectangular region is measured, and a Mo concentration (mass %) at every individual measurement point is calculated using a calibration curve prepared in advance from a characteristic X-ray strength of Mo—K shell excitation.

Next, the reason for limiting the mechanical properties of the steel pipe according to aspects of the present invention is described.

The value ($\sigma_{0.7}/\sigma_{0.4}$), as a ratio of a stress ($\sigma_{0.7}$) at a strain of 0.7% to a stress ($\sigma_{0.4}$) at a strain of 0.4% in the stress-strain curve, is 1.02 or less.

As described previously, the scattering in the $K_{ISSC}$ value is largely different according to the shape of the stress-strain curve of steel. The present inventors made extensive and intensive investigations regarding this point. As a result, it has been found that in the case where the value ($\sigma_{0.7}/\sigma_{0.4}$), as a ratio of a stress ($\sigma_{0.7}$) at a strain of 0.7% to a stress ($\sigma_{0.4}$) at a strain of 0.4% in the stress-strain curve, is 1.02 or less, the scattering in the $K_{ISSC}$ value is reduced. For this reason, the ($\sigma_{0.7}/\sigma_{0.4}$) is limited to 1.02 or less.

In accordance with aspects of the present invention, the yield strength, the stress ($\sigma_{0.4}$) at a strain of 0.4%, and the stress ($\sigma_{0.7}$) at a strain of 0.7% can be measured by the tensile test in conformity with JIS Z2241.

In addition, though the micro structure according to aspects of the present invention is not particularly limited, so long as the structure is composed of martensite as a major phase, with the balance being one or more structures of ferrite, residual austenite, perlite, bainite, and the like in an area ratio of 5% or less, the object of aspects of the invention of the present application can be achieved.

Example 1

Aspects of the present invention are hereunder described in more detail by reference to Examples.

A steel of each of compositions shown in Table 1 was refined by the converter method and then continuously cast to prepare a bloom or a billet having a round cross section.

The bloom slab was formed into a billet having a round cross section by a raw material billet production method as shown in each of Tables 2 to 4. Thereafter, such a billet having a round cross section was used as a raw material and heated and held at a billet heating temperature shown in each of Tables 2 to 4, and then hot-rolled by Mannesmann piercing—plug mill rolling—diameter-reducing process, thereby forming into each of thick-walled seamless steel pipes shown in Tables 2 to 4.

The steel pipe was cooled to room temperature (35° C. or lower) by means of direct quenching (DQ) or air cooling (0.1 to 0.3° C./s) and then heat treated under a heat treatment condition of steel pipe shown in Tables 2 to 4 (Q1 temperature: first quenching temperature, T1 temperature: first tempering temperature, Q2 temperature: second quenching temperature, and T2 temperature: second tempering temperature). In the steel pipe Nos. 8 and 9, prior to the quenching and tempering treatment of steel pipe, a normalizing (N) treatment of heating the steel pipe at 1,100° C. or higher and holding for at least 5 hours, followed by air cooling was performed. A sample for EPMA measurement of a longitudinal orthogonal cross section, a tensile specimen in parallel to the longitudinal direction of pipe, and a DCB specimen were each taken from an optional one place in the circumferential direction of an end of the pipe at the stage of finishing of final tempering heat treatment. The three or more DCB specimens were respectively taken from every steel pipes.

Using the collected EPMA measurement samples, the EPMA quantitative planar analysis was performed under conditions at an accelerating voltage of 20 kV, a beam current of 0.5 μA, and a beam diameter of 10 μm (number of measurement points: 6,750,000) with respect to a predetermined rectangular region, and a Mo concentration (mass %) at every individual measurement point was calculated using a calibration curve prepared in advance from a characteristic X-ray strength of Mo—K shell excitation. This value was divided by an average value of all of the measurement points and was defined as a Mo segregation degree, after statistical treatment, a cumulative frequency rate graph was prepared, and the cumulative frequency rate at the measurement point at which the Mo segregation degree was 1.5 or more was read.

In addition, using the collected tensile specimen, a yield strength, a stress ($\sigma_{0.4}$) at a strain of 0.4%, and a stress ($\sigma_{0.7}$) at a strain of 0.7% were measured by performing the tensile test in conformity with JIS Z2241.

In addition, using the collected DCB specimens, the DCB test was carried out in conformity with the NACE TM0177 method D. As a test bath of the DCB test, an aqueous solution of (5 mass % NaCl+0.5 mass % $CH_3COOH$) of 24° C. as saturated with a hydrogen sulfide gas of 1.0 atm (0.1 MPa) was used. The DCB specimens into which a wedge had been introduced under a predetermined condition were immersed in this test bath for 336 hours, a length a of a crack generated in the DCB specimens during the immersion and a lift-off load P were then measured, and $K_{ISSC}$ (MPa√m) was calculated according to the following equation (2).

In the case where the yield strength was 758 MPa or more, such was judged to be accepted. In addition, in the case where in all of the three DCB specimens, the $K_{ISSC}$ value was 26.4 MPa√m or more, such was judged to be accepted.

$$K_{ISSC}=\{Pa(2\sqrt{3}+2.38h/a)(B/B_n)^{1/\sqrt{3}}\}/Bh^{3/2} \quad (2)$$

Here, h is a height of each arm of the DCB specimen; B is a thickness of the DCB specimen; and $B_n$ is a web thickness of the DCB specimen. For these, numerical values prescribed in the NACE TM0177 method D were used (see FIG. 1).

TABLE 1

| Steel | Chemical composition (mass %) | | | | | | | | | | |
|---|---|---|---|---|---|---|---|---|---|---|---|
| No. | C | Si | Mn | P | S | O | Al | Cu | Cr | Mo | V |
| A | 0.29 | 0.02 | 0.56 | 0.009 | 0.0009 | 0.0009 | 0.025 | 0.03 | 1.00 | 0.91 | 0.045 |
| B | 0.27 | 0.28 | 0.59 | 0.010 | 0.0010 | 0.0008 | 0.028 | 0.04 | 1.30 | 0.94 | 0.047 |
| C | 0.25 | 0.02 | 0.65 | 0.010 | 0.0008 | 0.0010 | 0.022 | 0.02 | 1.26 | 0.96 | 0.049 |
| D | 0.26 | 0.01 | 0.61 | 0.010 | 0.0010 | 0.0008 | 0.033 | 0.03 | 1.49 | 0.93 | 0.046 |
| E | 0.25 | 0.19 | 0.57 | 0.009 | 0.0009 | 0.0011 | 0.029 | 0.04 | 0.91 | 1.26 | 0.046 |
| F | 0.29 | 0.03 | 0.55 | 0.010 | 0.0008 | 0.0010 | 0.024 | 0.02 | 0.97 | 0.91 | 0.045 |
| G | 0.30 | 0.03 | 0.58 | 0.010 | 0.0009 | 0.0009 | 0.027 | 0.03 | 1.00 | 0.92 | 0.051 |
| H | 0.26 | 0.04 | 0.64 | 0.009 | 0.0008 | 0.0009 | 0.026 | 0.02 | 1.28 | 0.97 | 0.048 |
| I | 0.26 | 0.03 | 0.63 | 0.008 | 0.0007 | 0.0010 | 0.033 | 0.07 | 0.99 | 0.91 | 0.055 |
| J | 0.24 | 0.16 | 0.55 | 0.010 | 0.0009 | 0.0012 | 0.025 | 0.06 | 1.00 | 0.98 | 0.044 |
| K | 0.32 | 0.02 | 0.57 | 0.009 | 0.0008 | 0.0009 | 0.025 | 0.02 | 0.82 | 0.92 | 0.046 |
| L | 0.30 | 0.21 | 0.54 | 0.009 | 0.0009 | 0.0009 | 0.023 | 0.09 | 0.99 | 0.92 | 0.046 |
| M | 0.25 | 0.03 | 0.73 | 0.008 | 0.0009 | 0.0008 | 0.024 | 0.03 | 0.88 | 0.93 | 0.045 |
| N | 0.29 | 0.32 | 0.56 | 0.010 | 0.0008 | 0.0013 | 0.025 | 0.05 | 0.70 | 0.99 | 0.045 |
| O | 0.31 | 0.13 | 0.55 | 0.009 | 0.0010 | 0.0011 | 0.022 | 0.04 | 1.00 | 0.80 | 0.046 |
| P | 0.26 | 0.04 | 0.58 | 0.010 | 0.0010 | 0.0010 | 0.025 | 0.04 | 0.80 | 1.70 | 0.043 |
| Q | 0.29 | 0.03 | 0.56 | 0.010 | 0.0010 | 0.0010 | 0.024 | 0.03 | 1.04 | 0.91 | 0.044 |
| R | 0.30 | 0.04 | 0.55 | 0.010 | 0.0010 | 0.0009 | 0.025 | 0.04 | 1.02 | 0.90 | 0.044 |
| S | 0.29 | 0.03 | 0.56 | 0.009 | 0.0009 | 0.0008 | 0.023 | 0.03 | 1.03 | 0.93 | 0.046 |

| Steel | Chemical composition (mass %) | | | | | | | |
|---|---|---|---|---|---|---|---|---|
| No. | Nb | B | Ti | N | W | Zr | Ti/N | Division |
| A | 0.015 | 0.0020 | 0.012 | 0.0035 | — | — | 3.4 | Compatible example |
| B | 0.035 | 0.0024 | 0.015 | 0.0039 | — | — | 3.8 | Compatible example |
| C | 0.045 | 0.0028 | 0.011 | 0.0036 | — | — | 3.1 | Compatible example |
| D | 0.008 | 0.0026 | 0.009 | 0.0027 | — | — | 3.3 | Compatible example |
| E | 0.011 | 0.0026 | 0.014 | 0.0044 | | | 3.2 | Compatible example |
| F | 0.016 | 0.0021 | 0.013 | 0.0033 | 0.12 | — | 3.9 | Compatible example |
| G | 0.014 | 0.0025 | 0.012 | 0.0034 | — | 0.014 | 3.5 | Compatible example |
| H | 0.044 | 0.0022 | 0.016 | 0.0048 | 0.17 | 0.024 | 3.3 | Compatible example |

TABLE 1-continued

| | | | | | | | | |
|---|---|---|---|---|---|---|---|---|
| I | 0.008 | 0.0027 | 0.012 | 0.0033 | — | — | 3.6 | Compatible example |
| J | 0.015 | 0.0020 | 0.013 | 0.0033 | — | — | 3.9 | Comparison |
| K | 0.011 | 0.0016 | 0.014 | 0.0036 | — | — | 3.9 | Comparison |
| L | 0.017 | 0.0022 | 0.015 | 0.0040 | — | — | 3.8 | Comparison |
| M | 0.009 | 0.0017 | 0.012 | 0.0033 | — | — | 3.6 | Comparison |
| N | 0.016 | 0.0021 | 0.013 | 0.0043 | — | — | 3.0 | Comparison |
| O | 0.018 | 0.0023 | 0.012 | 0.0038 | — | — | 3.2 | Comparison |
| P | 0.012 | 0.0015 | 0.013 | 0.0037 | — | — | 3.5 | Comparison |
| Q | 0.014 | 0.0009 | 0.015 | 0.0038 | — | — | 3.9 | Comparison |
| R | 0.014 | 0.0022 | 0.013 | 0.0047 | — | — | 2.8 | Comparison |
| S | 0.017 | 0.0021 | 0.012 | 0.0028 | — | — | 4.3 | Comparison |

The underlined portions fall outside the scope of the present invention.

The balance other than the above-described components is Fe and inevitable impurities.

TABLE 2

| | | | | Hot rolling condition of bloom | | | | | Hot rolling condition of steel pipe | | | Steel pipe heat treatment condition | |
|---|---|---|---|---|---|---|---|---|---|---|---|---|---|
| Steel pipe No.. | Steel No. | Ti/N | Slab | Equalization temperature of bloom (° C.) | Equalization time of bloom (hr) | Wall thickness (mm) | Outer diameter (mm) | Billet heating (° C.) | Finish of hot rolling (° C.) | Cooling after hot rolling | Normalizing (N) treatment | Q1 temperature (° C.) |
| 1 | A | 3.4 | Bloom | 1250 | 20 | 44.5 | 232.0 | 1202 | 988 | DQ | — | 880 |
| 2 | B | 3.8 | Bloom | 1251 | 20 | 44.5 | 232.0 | 1199 | 1003 | DQ | — | 881 |
| 3 | C | 3.1 | Bloom | 1250 | 20 | 51.0 | 234.8 | 1204 | 1055 | DQ | — | 888 |
| 4 | D | 3.3 | Bloom | 1251 | 20 | 56.1 | 355.6 | 1201 | 1069 | DQ | — | 889 |
| 5 | E | 3.2 | Bloom | 1252 | 25 | 56.1 | 355.6 | 1196 | 1028 | DQ | — | 871 |
| 6 | F | 3.9 | Bloom | 1250 | 20 | 44.5 | 232.0 | 1198 | 997 | DQ | — | 879 |
| 7 | G | 3.5 | Bloom | 1250 | 20 | 44.5 | 232.0 | 1202 | 1011 | DQ | — | 891 |
| 8 | H | 3.3 | Bloom | 1252 | 20 | 51.0 | 234.8 | 1211 | 1061 | DQ | — | 890 |
| 9 | I | 3.6 | Round billet | — | — | 44.5 | 232.0 | 1253 | 1017 | DQ | Held at 1150° C. for 5 hr | 872 |
| 10 | I | 3.6 | Round billet | — | — | 44.5 | 232.0 | 1266 | 1023 | Air cooling | Held at 1100° C. for 5 hr | 899 |

| | Steel pipe heat treatment condition | | | Cumulative frequency rate of (EPMA Mo value)/(EPMA MO) ave. ≥ 1.5 (%) | | | | | | |
|---|---|---|---|---|---|---|---|---|---|---|
| Steel pipe No.. | T1 temperature (° C.) | Q2 temperature (° C.) | T2 temperature (° C.) | | Yield strength (MPa) | $\sigma_{0.4}$ | $\sigma_{0.7}$ | $\sigma_{0.7}/\sigma_{0.4}$ | $K_{ISSC}$ (MPa√m) | Remark |
| 1 | 550 | 881 | 685 | 0.8 | 813 | 845 | 811 | 0.96 | 27.7<br>28.3<br>29.2 | Invention |
| 2 | 690 | — | — | 0.9 | 806 | 797 | 805 | 1.01 | 26.7<br>27.4<br>28.2 | Invention |
| 3 | 550 | 891 | 686 | 0.9 | 799 | 827 | 802 | 0.97 | 28.3<br>28.6<br>29.6 | Invention |
| 4 | 679 | — | — | 0.8 | 807 | 800 | 808 | 1.01 | 26.6<br>28.3<br>30.8 | Invention |
| 5 | 505 | 874 | 713 | 1.0 | 819 | 819 | 819 | 1.00 | 27.0<br>27.6<br>28.8 | Invention |
| 6 | 599 | 888 | 690 | 0.9 | 816 | 847 | 813 | 0.96 | 27.4<br>28.5<br>29.0 | Invention |
| 7 | 600 | 889 | 688 | 0.8 | 821 | 844 | 819 | 0.97 | 27.3<br>27.7<br>28.5 | Invention |
| 8 | 601 | 891 | 801 | 0.8 | 803 | 842 | 800 | 0.95 | 28.1<br>28.7<br>29.3 | Invention |

TABLE 2-continued

| | | | | | | | | | | | |
|---|---|---|---|---|---|---|---|---|---|---|---|
| | 9 | 549 | 869 | 706 | 1.0 | 787 | 775 | 790 | 1.02 | 26.4<br>28.7<br>29.4 | Invention |
| | 10 | 500 | 877 | 690 | 1.0 | 811 | 796 | 812 | 1.02 | 26.4<br>28.1<br>29.2 | Invention |

TABLE 3

| | | | | Hot rolling condition of bloom | | | | Hot rolling condition of steel pipe | | | Steel pipe heat treatment condition | |
|---|---|---|---|---|---|---|---|---|---|---|---|---|
| Steel pipe No. | Steel No. | Ti/N | Slab | Equalization temperature of bloom (° C.) | Equalization time of bloom (hr) | Wall thickness (mm) | Outer diameter (mm) | Billet heating (° C.) | Finish of rolling (° C.) | Cooling after rolling | Normalizing (N) treatment | Q1 temperature (° C.) |
| 11 | I | 3.8 | Round billet | — | — | 44.5 | 232.0 | 1201 | 989 | DQ | — | 890 |
| 12 | I | 3.6 | Round billet | — | — | 44.5 | 232.0 | 1268 | 1031 | Air cooling | — | 892 |
| 13 | A | 3.9 | Bloom | 1198 | 1 | 44.5 | 232.0 | 1200 | 994 | DQ | — | 890 |
| 14 | A | 3.2 | Bloom | 1250 | 20 | 44.5 | 232.0 | 1258 | 1019 | DQ | — | 890 |
| 15 | A | 3.6 | Bloom | 1251 | 20 | 44.5 | 232.0 | 1255 | 1027 | DQ | — | 891 |
| 16 | J | 3.9 | Bloom | 1250 | 20 | 44.5 | 232.0 | 1263 | 1039 | DQ | — | 891 |
| 17 | K | 3.9 | Bloom | 1253 | 20 | 44.5 | 232.0 | 1258 | 1021 | DQ | — | 878 |
| 18 | L | 3.8 | Bloom | 1251 | 20 | 44.5 | 232.0 | 1261 | 1012 | DQ | — | 889 |

| | Steel pipe heat treatment condition | | | Cumulative frequency rate of (EPMA Mo value)/(EPMA Mo ave.) ≥ 1.5 (%) | | | | | | |
|---|---|---|---|---|---|---|---|---|---|---|
| Steel pipe No. | T1 temperature (° C.) | Q2 temperature (° C.) | T2 temperature (° C.) | | Yield strength (MPa) | $\sigma_{0.4}$ | $\sigma_{0.7}$ | $\sigma_{0.7}/\sigma_{0.4}$ | $K_{ISSC}$ (MPa√m) | Remark |
| 11 | 599 | 885 | 684 | 11 | 804 | 791 | 807 | 1.02 | 25.3<br>27.4<br>29.4 | Comparison |
| 12 | 545 | 876 | 688 | 9 | 799 | 785 | 801 | 1.02 | 24.9<br>26.7<br>28.9 | Comparison |
| 13 | 553 | 889 | 683 | 6 | 797 | 783 | 799 | 1.02 | 25.7<br>27.6<br>28.4 | Comparison |
| 14 | 549 | 893 | 640 | 0.8 | 793 | 728 | 794 | 1.09 | 26.2<br>28.1<br>29.0 | Comparison |
| 15 | 599 | 855 | 680 | 1.0 | 791 | 755 | 793 | 1.05 | 26.1<br>27.6<br>28.4 | Comparison |
| 16 | 602 | 890 | 685 | 0.9 | 747 | 745 | 745 | 1.00 | 29.5<br>29.7<br>31.4 | Comparison |
| 17 | 549 | 880 | 711 | 1.0 | 844 | 807 | 847 | 1.05 | 25.6<br>26.2<br>29.1 | Comparison |
| 18 | 599 | 890 | 685 | 0.8 | 751 | 756 | 752 | 0.99 | 29.4<br>30.1<br>30.8 | Comparison |

The underlined portions fall outside the scope of the present invention.

TABLE 4

| Steel pipe No. | Steel No. | Ti/N | Slab | Hot rolling condition of bloom: Equalization temperature of bloom (° C.) | Hot rolling condition of bloom: Equalization time of bloom (hr) | Wall thickness (mm) | Outer diameter (mm) | Hot rolling condition of steel pipe: Billet heating (° C.) | Hot rolling condition of steel pipe: Finish of rolling (° C.) | Hot rolling condition of steel pipe: Cooling after rolling | Steel pipe heat treatment condition: Normalizing (N) treatment | Steel pipe heat treatment condition: Q1 temperature (° C.) |
|---|---|---|---|---|---|---|---|---|---|---|---|---|
| 19 | M | 3.6 | Bloom | 1250 | 20 | 44.5 | 232.0 | 1259 | 1026 | DQ | — | 880 |
| 20 | N | 3.0 | Bloom | 1251 | 20 | 44.5 | 232.0 | 1258 | 1033 | DQ | — | 893 |
| 21 | O | 3.2 | Bloom | 1250 | 20 | 44.5 | 232.0 | 1261 | 1021 | DQ | — | 890 |
| 22 | P | 3.5 | Bloom | 1252 | 20 | 44.5 | 232.0 | 1258 | 1017 | DQ | — | 881 |
| 23 | Q | 3.9 | Bloom | 1250 | 20 | 44.5 | 232.0 | 1258 | 1011 | DQ | — | 891 |
| 24 | R | 2.8 | Bloom | 1250 | 20 | 44.5 | 232.0 | 1255 | 1021 | DQ | — | 889 |
| 25 | S | 4.3 | Bloom | 1251 | 20 | 44.5 | 232.0 | 1261 | 1014 | DQ | — | 888 |

| Steel pipe No. | Steel pipe heat treatment condition: T1 temperature (° C.) | Steel pipe heat treatment condition: Q2 temperature (° C.) | Steel pipe heat treatment condition: T2 temperature (° C.) | Cumulative frequency rate of (EPMA Mo value)/(EPMA Mo ave.) ≥ 1.5 (%) | Yield strength (MPa) | $\sigma_{0.4}$ | $\sigma_{0.7}$ | $\sigma_{0.7}/\sigma_{0.4}$ | $K_{ISSC}$ (MPa√m) | Remark |
|---|---|---|---|---|---|---|---|---|---|---|
| 19 | 551 | 879 | 710 | 1.0 | 821 | 790 | 822 | 1.04 | 25.8<br>27.9<br>29.4 | Comparison |
| 20 | 601 | 890 | 680 | 0.9 | 742 | 734 | 741 | 1.01 | 28.6<br>29.8<br>30.9 | Comparison |
| 21 | 603 | 890 | 685 | 0.7 | 749 | 743 | 750 | 1.01 | 28.7<br>29.6<br>30.7 | Comparison |
| 22 | 552 | 877 | 708 | 3 | 851 | 828 | 853 | 1.03 | 23.9<br>26.3<br>28.2 | Comparison |
| 23 | 597 | 890 | 680 | 0.8 | 781 | 739 | 783 | 1.06 | 25.9<br>26.1<br>28.9 | Comparison |
| 24 | 600 | 890 | 685 | 0.9 | 773 | 723 | 774 | 1.07 | 26.1<br>26.3<br>29.4 | Comparison |
| 25 | 602 | 890 | 685 | 0.8 | 804 | 774 | 805 | 1.04 | 26.2<br>27.0<br>29.2 | Comparison |

The underlined portions fall outside the scope of the present invention.

In all of the steel pipes 1 to 10 which fall within the scope of the present invention in terms of the chemical composition, the cumulative frequency rate at the EPMA measurement point at which the Mo segregation degree is 1.5 or more, and ($\sigma_{0.7}/\sigma_{0.4}$), the yield strength was 758 MPa or more, and all of the $K_{ISSC}$ values obtained in the DCB test of every three specimens satisfied the target 26.4 MPa√m or more without being largely scattered.

On the other hand, in Comparative Examples 11, 12, and 13 in which though the chemical composition was compatible with the scope of the present invention, the segregation reducing treatment was not performed, and the cumulative frequency rate at the EPMA measurement point at which the Mo segregation degree is 1.5 or more was more than the scope of the present invention, the $K_{ISSC}$ value was largely scattered, and one of the three specimens in the DCB test did not satisfy the target 26.4 MPa√m or more.

Similarly, in Comparative Example 14 in which though the chemical composition was compatible with the scope of the present invention, the final tempering temperature was low, or in Comparative Example 15 in which the quenching temperature before the final tempering was low, the ($\sigma_{0.7}/\sigma_{0.4}$) fell outside the scope of the present invention. As a result, the $K_{ISSC}$ value was largely scattered, and one of the three specimens in the DCB test did not satisfy the target 26.4 MPa√m or more.

In addition, in Comparative Examples 16 (steel No. J), 18 (steel No. L), 20 (steel No. N), and 21 (steel No. O), in which the contents of C, Mn, Cr, and Mo of the chemical composition were less than the lower limits of the scope of the present invention, the target yield strength of 758 MPa or more could not be achieved.

In Comparative Examples 17 (steel No. K), 19 (steel No. M), and 22 (steel No. P), in which the contents of C, Mn, and Mo of the chemical composition were more than the upper limits of the scope of the present invention, the ($\sigma_{0.7}/\sigma_{0.4}$) fell outside the scope of the present invention. As a result, the $K_{ISSC}$ value was largely scattered, and one or two of the three specimens in the DCB test did not satisfy the target 26.4 MPa√m or more.

In addition, in Comparative Example 23 (steel No. Q), in which the content of B of the chemical composition was less than the lower limit of the scope of the present invention, the ($\sigma_{0.7}/\sigma_{0.4}$) fell outside the scope of the present invention. As a result, the $K_{ISSC}$ value was largely scattered, and two of the three specimens in the DCB test did not satisfy the target 26.4 MPa√m or more.

In Comparative Example 24 (steel No. R), in which the Ti/N ratio was less than the lower limit of the invention, the ($\sigma_{0.7}/\sigma_{0.4}$) fell outside the scope of the present invention. As a result, the $K_{ISSC}$ value was largely scattered, and two of the three specimens in the DCB test did not satisfy the target 26.4 MPa√m or more. In addition, in Comparative Example 25 (steel No. S), in which the Ti/N ratio was more than the upper limit of the invention, the ($\sigma_{0.7}/\sigma_{0.4}$) fell outside the scope of the present invention. As a result, the $K_{ISSC}$ value was largely scattered, and one of the three specimens in the DCB test did not satisfy the target 26.4 MPa√m or more.

Example 2

A steel of each of compositions shown in Table 5 was refined by the converted method and then continuously cast to prepare a bloom. This bloom was formed into a billet having a round cross section by means of hot rolling. Furthermore, this billet was used as a raw material, heated at a billet heating temperature shown in Table 6, and then hot-rolled by Mannesmann piercing—plug mill rolling—diameter-reducing process, and rolling was finished at a rolling finishing temperature shown in Table 6, thereby forming a seamless steel pipe.

The steel pipe was cooled to room temperature (35° C. or lower) by means of direct quenching (DQ) or air cooling (0.2 to 0.5° C./s) and then heat treated under a heat treatment condition of steel pipe shown in Table 6 (Q1 temperature: first quenching temperature, T1 temperature: first tempering temperature, Q2 temperature: second quenching temperature, and T2 temperature: second tempering temperature). A sample for SEM of a longitudinal orthogonal cross section, a sample for EPMA measurement, a tensile specimen in parallel to the longitudinal direction of pipe, and DCB specimens were each taken from an optional one place in the circumferential direction of an end of the pipe at the stage of finishing of final tempering. The three or more DCB specimens were respectively taken from every steel pipes.

With respect to the collected sample for SEM, three places of the pipe outer surface, thick-walled center, and inner surface were subjected to SEM observation of inclusions, a chemical composition was analyzed with a characteristic X-ray analyzer annexed to the SEM, and the number (per 100 $mm^2$) of oxide-based non-metallic inclusions in steel comprising of Ca and Al and having a maximum bulk size of 5 μm or more and satisfying the equation (1) was calculated.

$$(CaO)/(Al_2O_3) \geq 4.0 \quad (1)$$

In addition, using the collected EPMA measurement samples, the EPMA quantitative planar analysis was performed under conditions at an accelerating voltage of 20 kV, a beam current of 0.5 μA, and a beam diameter of 10 μm (number of measurement points: 6,750,000) with respect to a predetermined rectangular region, and a Mo concentration (mass %) at every individual measurement point was calculated using a calibration curve prepared in advance from a characteristic X-ray strength of Mo—K shell excitation. This value was divided by an average value at all of the measurement points and was defined as a Mo segregation degree, after statistical treatment, a cumulative frequency rate graph was prepared, and the cumulative frequency rate at the measurement point at which the Mo segregation degree was 1.5 or more was read.

In addition, using the collected tensile specimen, a yield strength, a stress ($\sigma_{0.4}$) at a strain of 0.4%, and a stress ($\sigma_{0.7}$) at a strain of 0.7% were measured by the performing tensile test in conformity with JIS Z2241.

In addition, using the collected DCB specimen, the DCB test was carried out in conformity with the NACE TM0177 method D. As a test bath of the DCB test, an aqueous solution of (5 mass % of NaCl+0.5 mass % $CH_3COOH$) of 24° C. as saturated with a hydrogen sulfide gas of 1.0 atm (0.1 MPa) was used. The DCB specimens into which a wedge had been introduced under a predetermined condition were immersed in this test bath for 336 hours, a length a of a crack generated in the DCB specimens during the immersion and a lift-off load P were then measured, and $K_{ISSC}$ (MPa√m) was calculated according to the foregoing equation (2).

In the case where the yield strength was 758 MPa or more, such was judged to be accepted. In addition, in the case where in all of the three DCB specimens, the $K_{ISSC}$ value was 26.4 MPa√m or more, such was judged to be accepted.

TABLE 5

| Steel | Chemical composition (mass %) | | | | | | | | | | |
|---|---|---|---|---|---|---|---|---|---|---|---|
| No. | C | Si | Mn | P | S | O | Al | Cu | Cr | Mo | V |
| T | 0.28 | 0.02 | 0.62 | 0.010 | 0.0008 | 0.0010 | 0.021 | 0.02 | 0.98 | 0.98 | 0.042 |
| U | 0.28 | 0.04 | 0.61 | 0.009 | 0.0006 | 0.0009 | 0.024 | 0.03 | 0.99 | 0.97 | 0.045 |
| V | 0.26 | 0.03 | 0.66 | 0.009 | 0.0007 | 0.0009 | 0.031 | 0.04 | 1.27 | 0.95 | 0.041 |
| W | 0.25 | 0.03 | 0.58 | 0.009 | 0.0010 | 0.0010 | 0.022 | 0.03 | 1.47 | 0.92 | 0.045 |
| X | 0.29 | 0.33 | 0.55 | 0.010 | 0.0005 | 0.0008 | 0.016 | 0.08 | 1.01 | 0.93 | 0.041 |
| Y | 0.28 | 0.04 | 0.59 | 0.009 | 0.0010 | 0.0010 | 0.023 | 0.03 | 1.00 | 1.00 | 0.043 |
| Z | 0.29 | 0.03 | 0.61 | 0.009 | 0.0009 | 0.0009 | 0.022 | 0.04 | 0.97 | 0.99 | 0.044 |

| Steel | Chemical composition (mass %) | | | | | | | | |
|---|---|---|---|---|---|---|---|---|---|
| No. | Nb | B | Ti | N | W | Zr | Ca | Ti/N | Division |
| T | 0.017 | 0.0021 | 0.009 | 0.0027 | — | — | 0.6013 | 3.3 | Compatible example |
| U | 0.018 | 0.0026 | 0.010 | 0.0029 | — | — | 0.0018 | 3.4 | Compatible example |
| V | 0.047 | 0.0023 | 0.012 | 0.0033 | 0.18 | — | 0.0015 | 3.6 | Compatible example |
| W | 0.010 | 0.0028 | 0.011 | 0.0035 | — | 0.022 | 0.0014 | 3.1 | Compatible example |
| X | 0.016 | 0.0027 | 0.013 | 0.0037 | 0.13 | 0.013 | 0.0012 | 3.5 | Compatible example |

TABLE 5-continued

| | | | | | | | | | |
|---|---|---|---|---|---|---|---|---|---|
| Y | 0.019 | 0.0022 | 0.010 | 0.0031 | — | — | 0.0035 | 3.2 | Comparison |
| Z | 0.018 | 0.0024 | 0.009 | 0.0025 | — | — | 0.0028 | 3.6 | Compatible example |

The underlined portions fall outside the scope of the present invention.
The balance other than the above-described components is Fe and inevitable impurities.

TABLE 6

| | | | | | Hot rolling condition of bloom | | | | Hot rolling condition of steel pipe | | | Steel pipe heat treatment condition | |
|---|---|---|---|---|---|---|---|---|---|---|---|---|---|
| Steel pipe No. | Steel No. | Ti/N | Number of inclusions (per 100 mm$^2$) (*1) | Slab | Equalization temperature of bloom (° C.) | Equalization time of bloom (hr) | Wall thickness (mm) | Outer diameter (mm) — | Billet heating (° C.) | Finish of rolling (° C.) | Cooling after rolling | Normalizing (N) treatment | Q1 temperature (° C.) |
| 2-1 | T | 3.3 | 1 | Bloom | 1270 | 20 | 44.5 | 232.0 | 1194 | 979 | DQ | — | 875 |
| 2-2 | U | 3.4 | 14 | Billet | — | — | 44.5 | 232.0 | 1269 | 1023 | DQ | Held at 1130° C. at 5 hr | 895 |
| 2-3 | V | 3.6 | 2 | Bloom | 1250 | 20 | 51.0 | 234.8 | 1204 | 1063 | DQ | — | 883 |
| 2-4 | W | 3.1 | 1 | Bloom | 1251 | 20 | 56.1 | 355.6 | 1201 | 1069 | DQ | — | 879 |
| 2-5 | X | 3.5 | 0 | Bloom | 1252 | 25 | 44.5 | 232.0 | 1199 | 984 | DQ | — | 879 |
| 2-6 | Y | 3.2 | 47 | Bloom | 1265 | 20 | 44.5 | 232.0 | 1197 | 981 | DQ | — | 876 |
| 2-7 | Z | 3.6 | 29 | Bloom | 1267 | 20 | 44.5 | 232.0 | 1201 | 988 | DQ | — | 878 |

| Steel pipe No. | Steel pipe heat treatment condition T1 temperature (° C.) | Q2 temperature (° C.) | T2 temperature (° C.) | Cumulative frequency rate of (EPMA Mo value)/(EPMA Mo ave.) ≥ 1.5 (%) | Yield strength (MPa) | $\sigma_{0.4}$ | $\sigma_{0.7}$ | $\sigma_{0.7}/\sigma_{0.4}$ | $K_{ISSC}$ (MPa√m) | Remark |
|---|---|---|---|---|---|---|---|---|---|---|
| 2-1 | 560 | 875 | 682 | 0.7 | 818 | 845 | 816 | 0.97 | 27.2<br>28.6<br>30.1 | Invention |
| 2-2 | 535 | 872 | 684 | 0.9 | 808 | 797 | 806 | 1.01 | 26.6<br>27.9<br>30.9 | Invention |
| 2-3 | 540 | 885 | 679 | 0.8 | 791 | 804 | 793 | 0.99 | 28.1<br>29.4<br>29.9 | Invention |
| 2-4 | 553 | 878 | 677 | 0.8 | 802 | 789 | 800 | 1.01 | 26.9<br>28.5<br>30.4 | Invention |
| 2-5 | 547 | 877 | 678 | 0.8 | 822 | 808 | 819 | 1.01 | 26.8<br>28.1<br>29.3 | Invention |
| 2-6 | 554 | 577 | 681 | 0.8 | 821 | 833 | 819 | 0.98 | 23.3<br>26.5<br>28.5 | Comparison |
| 2-7 | 562 | 877 | 679 | 0.7 | 817 | 831 | 815 | 0.98 | 25.1<br>26.9<br>29.4 | Comparison |

The underlined portions fall outside the scope of the present invention.
(*1) Number (per 100 mm$^2$) of oxide-based non-metallic inclusions in steel satisfying a relation: $(CaO)/(Al_2O_3) \geq 4.0$ and having a major diameter of 5 μm or more.

In all of the steel pipes 2-1 to 2-5 which fall within the scope of the present invention in terms of the chemical composition, the number of inclusions, the cumulative frequency rate at the EPMA measurement point at which the Mo segregation degree is 1.5 or more, and ($\sigma_{0.7}/\sigma_{0.4}$), the yield strength was 758 MPa or more, and all of the $K_{ISSC}$ values obtained in the DCB test of every three specimens satisfied the target 26.4 MPa√m or more without being largely scattered.

On the other hand, in Comparative Example 2-6 (steel No. Y) in which the upper limit of Ca was more than the upper limit of the scope of the present invention, the $K_{ISSC}$ value was largely scattered, and one of the three specimens in the DCB test did not satisfy the target 26.4 MPa√m or more. In addition, in Comparative Example 2-7 (steel No. Z), the addition of Ca was performed without taking into consideration the state where the Ca amount in the molten steel before the addition of Ca was high due to Ca as an impurity in the raw material of other elements added during secondary refining. For that reason, though the Ca amount feel within the scope of the present invention, the number of oxide-based non-metallic inclusions in steel comprising of Ca and Al and having a maximum bulk size of 5 μm or more and satisfying the equation (1) was more than the upper limit of the scope of the present invention, the $K_{ISSC}$ value was largely scattered, and one of the three specimens in the DCB test did not satisfy the target 26.4 MPa√m or more.

The invention claimed is:

1. A seamless steel pipe for oil country tubular goods having a wall thickness of 40 mm or more and a yield strength of 758 MPa or more, the steel pipe comprising a composition containing, in terms of mass %, C: 0.25 to 0.31%,
Si: 0.01 to 0.35%,
Mn: 0.55 to 0.70%,
P: 0.010% or less,
S: 0.001% or less,
O: 0.0015% or less,
Al: 0.015 to 0.040%,
Cu: 0.02 to 0.09%,
Cr: 0.8 to 1.5%,
Mo: 0.9 to 1.6%,
V: 0.04 to 0.10%,
Nb: 0.005 to 0.05%,
B: 0.0015 to 0.0030%,
Ti: 0.005 to 0.020%,
N: 0.005% or less, and
Ca: 0.0005 to 0.0030%, and having a value of a ratio of the Ti content to the N content (Ti/N) of 3.0 to 4.0, with the balance being Fe and inevitable impurities, wherein a cumulative frequency rate is 1% or less in view of measurement points at which a Mo segregation degree is 1.5 or more which is measured in an overall thickness of a longitudinal orthogonal cross section of the pipe, as defined by the following expression (A); and the steel pipe has a value ($\sigma_{0.7}/\sigma_{0.4}$), as a ratio of a stress at a strain of 0.7% to a stress at a strain of 0.4% in a stress-strain curve, of 1.02 or less:

$$\text{Mo segregation degree}=(\text{EPMA Mo value})/(\text{EPMA Mo ave.}) \quad (A)$$

wherein

EPMA means to Electron Probe Micro Analyzer;

the (EPMA Mo value) is a Mo concentration value (mass %) of an individual measurement point at the time of the EPMA quantitative planar analysis measurement; and the (EPMA Mo ave.) is an average Mo concentration (mass %) of all of the measurement points at the time of the EPMA quantitative planar analysis measurement, and wherein the seamless steel pipe has the number of oxide-based non-metallic inclusions in steel comprising of Ca and Al and having a maximum bulk size of 5 μm or more, whose composition ratio satisfies, in terms of mass %, the following equation (1), of 20 or less per 100 $mm^2$:

$$(CaO)/(Al_2O_3) \geq 4.0 \quad (1).$$

2. The seamless steel pipe for oil country tubular goods according to claim 1, which further contains, in addition to the composition, one or more selected from, in terms of mass %, W: 0.1 to 0.2%, and
Zr: 0.005 to 0.03%.

* * * * *